US011805365B2

(12) United States Patent
Colich

(10) Patent No.: US 11,805,365 B2
(45) Date of Patent: Oct. 31, 2023

(54) ELECTROACOUSTIC DIAPHRAGM, TRANSDUCER, AUDIO DEVICE, AND METHODS HAVING SUBCIRCUITS

(71) Applicant: Audeze, LLC, Santa Ana, CA (US)

(72) Inventor: Dragoslav Colich, Orange, CA (US)

(73) Assignee: AUDEZE, LLC, Santa Clara, CA (US)

( * ) Notice: Subject to any disclaimer, the term of this patent is extended or adjusted under 35 U.S.C. 154(b) by 0 days.

(21) Appl. No.: 17/210,516

(22) Filed: Mar. 24, 2021

(65) Prior Publication Data

US 2022/0312120 A1 Sep. 29, 2022

(51) Int. Cl.
*H04R 7/06* (2006.01)
*H01F 7/02* (2006.01)

(52) U.S. Cl.
CPC ..... *H04R 7/06* (2013.01); *H01F 7/0289* (2013.01); *H04R 2307/027* (2013.01)

(58) Field of Classification Search
CPC ..... H04R 9/048; H04R 7/06; H04R 2307/027
USPC ..... 381/176, 399
See application file for complete search history.

(56) References Cited

U.S. PATENT DOCUMENTS 3,919,499 A 11/1975 Winey
4,001,522 A * 1/1977 Kasatkin ..... H04R 9/048 381/399
6,108,433 A * 8/2000 Norris ..... G10K 9/13 381/162
6,154,557 A * 11/2000 Montour ..... H04R 7/04 381/396
7,099,488 B2 8/2006 Bohlender
7,146,019 B2 * 12/2006 Levitsky ..... H04R 9/048 381/399
7,174,024 B1 * 2/2007 Suzuki ..... H04R 7/04 381/399
9,287,029 B1 3/2016 Colich
9,432,788 B2 8/2016 Colich et al.
2009/0067648 A1 * 3/2009 Liou ..... H04R 31/00 381/191
2011/0280419 A1 * 11/2011 Kasai ..... H04R 19/005 381/176
2015/0326976 A1 * 11/2015 Kushima ..... H04R 7/045 381/191

* cited by examiner

*Primary Examiner* — Suhan Ni
(74) *Attorney, Agent, or Firm* — Wayne R. Howe

(57) ABSTRACT

An electroacoustic diaphragm comprises a membrane, and an electrically conductive circuit carried by the membrane, such that a segment of the electrically conductive circuit is divided into two or more separate subcircuits. An electroacoustic transducer assembly comprises a frame, the novel diaphragm supported on the frame, and a magnetic element disposed adjacent the novel diaphragm whereby the transducer achieves uniform force distribution across the novel diaphragm. An audio device comprises a housing having an acoustic opening and the electroacoustic transducer including the novel diaphragm. Methods for constructing a transducer comprises determining the flux density of a magnetic field and configuring a diaphragm with separate subcircuits to correlate or inversely correlate to the flux density.

22 Claims, 25 Drawing Sheets

$I_{120a} = V_x / R_{120a}$ $I_{120b} = V_x / R_{120b}$ $I_{120c} = V_x / R_{120c}$

Graph of Varying Flux Strength B of Magnetic Elements 180 across diaphragm and subcircuits Graph of Varying Flux Strength B of Magnetic Elements 180 across diaphragm and subcircuits Graph of Varying Flux Strength B of Magnetic Elements 180 across diaphragm and subcircuits Graph of Varying Flux Strength B of Magnetic Elements 180 across diaphragm and subcircuits Graph of Varying Flux Strength B of Magnetic Elements 180 across diaphragm and subcircuits Graph of Varying Flux Strength B of Magnetic Elements 180 across diaphragm and subcircuits

ELECTROACOUSTIC DIAPHRAGM, TRANSDUCER, AUDIO DEVICE, AND METHODS HAVING SUBCIRCUITS

BACKGROUND

Planar magnetic transducers use a flat, lightweight diaphragm with conductive circuits suspended in a magnetic field. When energized with a voltage or current in the magnetic field, the conductive circuit creates forces that are transferred to the diaphragm which produces sound. These magnetic fields tend to emanate irregular generally nonlinear magnetic flux lines which vary in magnetic field strength depending upon the relative positions of the magnet with respect to the conductive circuits on the diaphragm.

Problems arise because the irregular and nonlinear magnetic fields for both the electro-magnetic and regular magnets cause the transduction of electrical energy into mechanical energy and then into sound to be nonlinear across the diaphragm, which causes sound distortion.

SUMMARY

The present disclosure relates to the use of circuits, traces, subcircuits and/or subtraces in electrical conductors used on or in diaphragms which interact with magnetic elements in electroacoustic transducers and audio devices.

It is desirable to design diaphragms and transducers whereby conductive circuits, traces, subcircuits, and/or subtraces on the diaphragm are configured to conduct different current flows in ways which more linearly correspond or correlate to varying magnetic field strengths such that equivalent, equal, similar, and/or comparable Lorentz forces are produced normal or perpendicular to the diaphragm in a way that is spread evenly across the diaphragm. These equivalent, equal, similar, and/or comparable Lorentz forces thereby produce a uniform force distribution across the diaphragm resulting in minimal sound distortion.

One solution is to divide the conductive circuit or circuits on the diaphragm into one or more separate subcircuits. Separate subcircuits enable different current strengths to be configured across the diaphragm which more precisely correspond to the varying magnetic field strengths and produce equivalent and/or comparable Lorentz forces.

A preferred aspect includes a diaphragm 100 comprising a membrane 110 having a surface, and an electrically conductive circuit 120 carried by the membrane 110, such that a segment 130 of the electrically conductive circuit 120 is divided into two or more separate subcircuits, for example 120*a*, 120*b*, and/or 120*c*.

An aspect includes a diaphragm 100 comprising a membrane 110 having a surface, and an electrically conductive circuit 120 supported by the membrane 110, wherein a segment 130 of the electrically conductive circuit 120 is operatively divided into two or more separate subcircuits, for example 120*a*, 120*b*, and/or 120*c*.

In one aspect, the membrane carries the electrically conductive circuit disposed on or affixed to one side of the membrane. In another aspect, the membrane carries the electrically conductive circuit disposed on or affixed to both sides of the membrane. In another aspect, the membrane carries the electrically conductive circuit within the membrane. In another aspect, the membrane carries the electrically conductive circuit both within the membrane and external to the membrane.

In one aspect, the membrane is non-conductive. In one aspect, the membrane is semi-conductive. In one aspect the membrane is flexible. In one aspect, the membrane is a thin film. In one aspect, the membrane is a substrate for the electrically conductive circuit. In one aspect, the electrically conductive circuit 120 is an electrically conductive path or trace on or in the membrane. In one aspect, the electrically conductive circuit 120 is metal or metal film.

In one aspect, a segment 130 is a part, section, subsection, area, leg, or length of the electrically conductive circuit 120. In one aspect, the segment 130 is divided, split, segmented, or separated into separate subcircuits, sub-paths, and/or sub-traces, for example 120*a*, 120*b*, and/or 120*c*.

In one aspect, the diaphragm 100 includes two or more separate subcircuits, for example 120*a*, 120*b*, and/or 120*c* of the segment 130 which extend for a length of the electrically conductive circuit 120. In one aspect, the diaphragm 100 includes two or more separate subcircuits, for example 120*a*, 120*b*, and/or 120*c* of the segment 130 which extend for a length of the electrically conductive circuit 120. In one aspect, a length of the electrically conductive circuit 120 is defined to mean a small length of the electrically conductive circuit. In one aspect, a length of the electrically conductive circuit 120 is defined to mean a large length or even most of the length of the electrically conductive circuit, but not necessarily the whole or the entire length of the circuit. In one aspect, a length of the electrically conductive circuit 120 is defined to mean the entire length of the electrically conductive circuit 120. In one aspect, a length of the electrically conductive circuit 120 is defined to mean the entire length of the electrically conductive circuit 120 except for the starting and/or ending points where the two or more separate subcircuits 120*a*, 120*b*, and/or 120*c* of the segment 130 are joined.

In one aspect, the electrically conductive circuit 120 comprises multiple parallel segments constructed in series. In one aspect, the multiple parallel segments have different lengths within each segment and/or different lengths from other parallel segments in the series. In one aspect, the number of subcircuits within each segment may vary. In one aspect, one segment may have multiple subcircuits while another segment has one or more subcircuits. There do not need to be an equal number of subcircuits per segment.

In another aspect, the diaphragm 100 comprises two or more separate subcircuits, for example 120*a*, 120*b*, and/or 120*c* which have different widths.

In another aspect, the diaphragm 100 includes at least two separate subcircuits, for example 120*a*, 120*b*, and/or 120*c* which have different thicknesses. These different thicknesses are perpendicular, normal, or angled with respect to the membrane. In another aspect, the diaphragm 100 comprises two or more separate subcircuits, for example 120*a*, 120*b*, and/or 120*c* which have different widths and different thicknesses.

In another aspect, the diaphragm 100 comprises two or more separate subcircuits 120*a*, 120*b*, or 120*c* which are electrically in parallel.

In another aspect, the diaphragm 100 includes two or more separate subcircuits 120*a*, 120*b*, and 120*c* which are electrically equivalent to a parallel impedance circuit 150 or a parallel resistance circuit.

In another aspect, the diaphragm 100 comprises two or more separate subcircuits, for example 120*a*, 120*b*, and/or 120*c* having different resistances, different impedances, and/or different conductivities.

In another aspect, the different resistances or impedances are determined by different heights, different widths, different shapes, different lengths, and different specific resistivities. These different subcircuit shapes comprise straight subcircuits, curved subcircuits, angled subcircuits, or serpentine subcircuits. Different specific resistivities comprise using the same materials or different materials having different specific resistivities p (rho).

In another aspect, the diaphragm 100 with a voltage 190 across the electrically conductive circuit 120 generates, forces, motivates, and/or pressures different electrical currents, for example I-1, I-2, I-3 through two or more separate subcircuits for example 120*a*, 120*b*, and/or 120*c*.

In another aspect, the diaphragm 100 includes positioning, configuring, adhering, and/or affixing the electrically conductive circuit 120 or subcircuits 120*a*, 120*b*, and/or 120*c* carried by the membrane 110 onto one side of the membrane 110, onto both sides of the membrane 110, and/or within the membrane 110.

Another aspect is a transducer 200 comprising a frame 205; a diaphragm 100 supported by the frame 205 wherein the diaphragm has a membrane 110 which carries an electrically conductive circuit 120, such that a segment 130 or specific section or length of the electrically conductive circuit is divided into two or more separate subcircuits, i.e., 120*a* and 120*b* and/or 120*c*; and a magnetic element 180 disposed adjacent to the diaphragm. In an aspect, the diaphragm 100 is supported by the frame 205, the diaphragm having a membrane 110, the membrane carrying an electrically conductive circuit 120 with a segment 130 of the electrically conductive circuit operably divided into two or more separate subcircuits 120*a*, 120*b*, 120*c*. In one aspect, the magnetic element is a magnet. In another aspect the magnetic element is an electromagnet. In one aspect, the frame is a rigid structure that supports the diaphragm and holds it under tension. In one aspect the frame is used to support the magnetic element 180. In another aspect, the magnetic element is held adjacent to the diaphragm by separate means.

In one aspect, transducer 200 comprises two or more separate subcircuits for example 120*a*, 120*b*, and/or 120*c* of the segment 130 which extend for a length of the electrically conductive circuit 120. In one aspect, a length of the electrically conductive circuit 120 is defined to mean a small length or a medium length or a large or extensive length of the electrically conductive circuit, but not necessarily the whole or the entire length of the circuit. In one aspect, a length of the electrically conductive circuit 120 is defined to mean less than $1/10^{th}$ of the length of the electrically conductive circuit 120. In one aspect, a length of the electrically conductive circuit 120 is defined to mean less than ½ of the length of the electrically conductive circuit 120. In one aspect, a length of the electrically conductive circuit 120 is defined to mean more than ½ of the length of the electrically conductive circuit 120. In one aspect, a length of the electrically conductive circuit 120 is defined to mean most (e.g., greater than 8/10ths) of the length of the electrically conductive circuit 120. In one aspect, a length of the electrically conductive circuit 120 is defined to mean the entire length of the electrically conductive circuit 120. In one aspect, a length of the electrically conductive circuit 120 is defined to mean the entire length of the electrically conductive circuit 120 except for the starting and ending points where the two or more separate subcircuits 120*a*, 120*b*, and/or 120*c* of the segment 130 are joined. In some aspects, multiple lengths of separate subcircuits are used. In some aspects multiple separate lengths of segments are used. In some aspects multiple lengths of segments are used with different lengths of different segments. In some aspects different lengths of different subcircuits are used.

In one aspect, when transducer 200 has a voltage connected across two or more separate subcircuits, for example 120*a*, 120*b*, and/or 120*c* or 120*d*, 120*e*, and/or 120*f* and/or 120*g*, 120*h*, and/or 120*i*, it generates two or more different current levels, strengths, and/or flows such as I-1, I-2, I-3, I-4, I-5, I-6, I-7, I-8, and/or I-9 in two or more of the separate subcircuits. In one aspect, the voltage connected across two or more separate subcircuits generates the same or similar current levels in two or more of the separate subcircuits.

In one aspect, transducer 200 includes varying flux strengths of magnetic element 180 across the diaphragm 100 which are correlated or inversely correlated with two or more separate subcircuits for example 120*a*, 120*b*, and/or 120*c* or 120*d*, 120*e*, and/or 120*f* and/or 120*g*, 120*h*, and/or 120*i* which conduct two or more different current levels such as I-1, I-2, I-3, I-4, I-5, I-6, I-7, I-8, and/or I-9 such that equivalent, equal, comparable, or similar Lorentz forces such as F1, F2, F3 F4, F5, F6 F7, F8, and/or F9 are generated in the two or more separate subcircuits. In one aspect, equivalent, equal, comparable, or similar Lorentz forces F1, F2, F3 F4, F5, F6 F7, F8, and/or F9 means that the majority of the Lorentz forces are equivalent, equal, comparable, or similar in two or more subcircuits. In one aspect, equivalent, equal, comparable, or similar Lorentz forces is defined to mean that the majority of the Lorentz forces F1, F2, F3 F4, F5, F6 F7, F8, and/or F9 are normal or perpendicular to the plane of the diaphragm at rest in two or more subcircuits. In one aspect, equivalent, equal, comparable, or similar Lorentz forces F1, F2, F3 F4, F5, F6 F7, F8, and/or F9 is defined to mean that the majority of the Lorentz forces are normal or perpendicular to the plane of the magnetic element 180 in two or more subcircuits. In one aspect, equivalent, equal, comparable, or similar Lorentz forces F1, F2, F3 F4, F5, F6 F7, F8, and/or F9 is defined to mean that the majority of the Lorentz forces F1, F2, F3 F4, F5, F6 F7, F8, and/or F9 are normal or perpendicular to the plane of the magnetic element 180. In one aspect, equivalent, equal, comparable, or similar Lorentz forces F1, F2, F3 F4, F5, F6 F7, F8, and/or F9 is defined to mean that the majority of the Lorentz forces F1, F2, F3 F4, F5, F6 F7, F8, and/or F9 are normal or perpendicular to the diaphragm 100 where the subcircuits intersect with the magnetic flux lines from the magnetic element 180.

In one aspect, equivalent, equal, comparable, or similar Lorentz forces F1, F2, F3 F4, F5, F6 F7, F8, and/or F9 means that at least two of the Lorentz forces in two or more subcircuits are within 8/10ths of each other. In one aspect, equivalent, equal, comparable, or similar Lorentz forces F1, F2, F3 F4, F5, F6 F7, F8, and/or F9 means that at least two of the Lorentz forces in two or more subcircuits are within 5/10ths of each other. In one aspect, equivalent, equal, comparable, or similar Lorentz forces F1, F2, F3 F4, F5, F6 F7, F8, and/or F9 means that at least one of the Lorentz forces in one of the subcircuits is at least half of the strength measured in a parallel direction to another Lorentz force in another subcircuit.

In one aspect, the transducer 200 includes equivalent, equal, comparable, or similar Lorentz forces F1, F2, F3 F4, F5, F6 F7, F8, and/or F9 generated in two or more separate subcircuits which exert a uniform normal pressure or uniform force distribution across the diaphragm. In one aspect, uniform normal pressure or uniform force distribution means the combined Lorentz forces exert a combined pressure across at least 50% of the diaphragm in a force normal or perpendicular to the plane of the diaphragm at rest. In one aspect, uniform normal pressure means that the combined Lorentz forces that are normal to the diaphragm exceed the combined Lorentz forces that are in the same plane as the diaphragm.

In some aspects, the performance characteristics of the transducer 200 comprise a uniform force distribution on the diaphragm 100, wherein the dimensions of the subcircuits or subtraces of the conductive circuits are selected to match, correspond to, correlate, or inversely correlate with the varying flux density of the magnetic field across the diaphragm 100 for the transducer 200.

In some aspects, the dimensions of the subcircuits have one or more of a width of less than 100 microns or a spacing of less than 100 microns between subtraces or subcircuits. In some aspects, the dimensions of the subcircuits have one or more of a width of less than 25 microns or a spacing of less than 25 microns between subtraces or subcircuits. In some aspects, the dimensions of the subcircuits have one or more of a width of less than 10 microns or a spacing of less than 10 microns between subtraces or subcircuits.

In some aspects, the dimensions of the subtraces or subcircuits include a large cross-section to reduce impedance or resistance of the circuit.

In some aspects, the performance characteristics of transducer 200 comprise a planar magnetic transducer capable of being driven from vacuum tubes, wherein the dimensions of the subtraces or subcircuits have one or more of a width of less than 100 microns or a spacing of less than 100 microns between subtraces or subcircuits. In some aspects, the dimensions of these subcircuits have one or more of a width of less than 10 microns or a spacing of less than 10 microns between subtraces or subcircuits.

In some aspects, the performance characteristics comprise matching the impedance of the conductive circuit to a specified load impedance, wherein the dimensions of the subtraces or subcircuits are determined for providing the matching.

In one aspect, transducer 200 includes a magnetic element 180 that comprises multiple magnetic elements 180 of angled or diagonally magnetized magnets, also called Fluxor® magnets that are described in U.S. Pat. No. 9,287,029.

In one aspect, transducer 200 includes magnetic element 180 which comprises multiple magnetic elements 180 disposed on both sides of the diaphragm.

In one aspect, transducer 200 includes magnetic element 180 which comprises multiple magnetic elements 180 which are disposed in direct opposition to each other. In one aspect, transducer 200 includes magnetic element 180 which comprises multiple magnetic elements 180 which are disposed in staggered positions or staggered opposition from each other. In one aspect, transducer 200 includes magnetic element 180 which comprises multiple magnetic elements 180 which are disposed in a combination of direct opposition and staggered positions or opposition from each other.

In one aspect, transducer 200 includes magnetic element 180 which is comprised of multiple magnets arranged or configured such that at least one set of magnets is configured in direct opposition, in staggered positions or staggered opposition, and/or in a combination of direct opposition and staggered positions or staggered opposition.

In one aspect, the transducer 200 has a magnetic element 180 which comprises multiple magnetic elements 180 including vertical magnets. In one aspect, the transducer 200 has a magnetic element 180 which comprises multiple magnetic elements 180 including vertical magnets with back plates. In one aspect, the transducer 200 has a magnetic element 180 which comprises multiple magnetic elements 180 including horizontal magnets. In one aspect, the transducer 200 has a magnetic element 180 which comprises multiple magnetic elements 180 including block magnets. In one aspect, the transducer 200 has a magnetic element 180 which comprises multiple magnetic elements 180 including disc magnets. In one aspect, the transducer 200 has a magnetic element 180 which comprises multiple magnetic elements 180 including U-channel magnets. In one aspect, the transducer 200 has a magnetic element 180 which comprises multiple magnetic elements 180 including horseshoe magnets. In one aspect, the transducer 200 has a magnetic element 180 which comprises multiple magnetic elements 180 including serpentine magnets. In one aspect, the transducer 200 has a magnetic element 180 which comprises multiple magnetic elements 180 including Halbach magnets of various configurations.

In one aspect, the transducer 200 comprises magnetic element 180 which includes a round magnet. In one aspect, the transducer 200 comprises magnetic element 180 which includes a curved magnet. In one aspect, the transducer 200 comprises magnetic element 180 which includes a straight magnet. In one aspect, the transducer 200 comprises magnetic element 180 which includes a square magnet. In one aspect, the transducer 200 comprises magnetic element 180 which includes a bar magnet.

One aspect is a transducer 200 comprising a frame 205 or other rigid structure; a diaphragm 100 supported by the frame 205 wherein the diaphragm 100 is described in other sections of this disclosure; and a magnetic element 180 disposed adjacent to the diaphragm wherein the magnetic element 180 is described in other sections of this disclosure.

Another aspect is an audio device 300 comprising a housing 310 having an acoustic opening 320 or aperture; and a transducer 200 disposed in the housing 310 wherein the transducer 200 is described in other sections of this disclosure. In one aspect, the transducer 200 disposed in the housing 310 includes a diaphragm 100 described in other sections of this disclosure. In one aspect, the audio device 300 is a speaker or loudspeaker. In another aspect, the audio device 300 is a headphone. In another aspect, the audio device 300 is an in-ear audio device. In another aspect, the audio device 300 is a microphone.

Another aspect is a method for constructing a transducer comprising the steps of determining 401 a flux density of a magnetic field and configuring 403 a diaphragm 100 so that two or more separate subcircuits 120*a*, 120*b*, and 120*c* correlate or inversely correlate to the flux density of the magnetic field. A further aspect is a method to ablate, delaminate, etch, erode, structure, create, manufacture, form, or embed subcircuits in and/or on the diaphragm 100 with lasers, chemicals, vaporization, deposition, or other means to achieve an optimized correlation of the flux density of the magnetic field with the dimensions of the subcircuits on the diaphragm. In a further aspect of a method, an application of an electric voltage across the electrically conductive subcircuits 120 creates a uniform force distribution across the subcircuits and the diaphragm.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the appended claims.

BRIEF DESCRIPTION OF THE DRAWINGS

Preferred embodiments and other aspects are illustrated by way of example, and not by way of limitation, in the figures of the accompanying drawings and in which like reference numerals refer to similar elements. In other embodiments and aspects multiple descriptive names are given to the same reference number element, for example subcircuit 120*a* is called a subcircuit and a subtrace, with both terms referring to the same subcircuit 120*a*.

FIG. 24*a* also shows that the transducer 200 comprises a diaphragm 100 as disclosed in FIGS. 1-23.

FIG. 24*b* also shows that the transducer 200 comprises a diaphragm 100 as disclosed in FIGS. 1-23.

Figure 1:
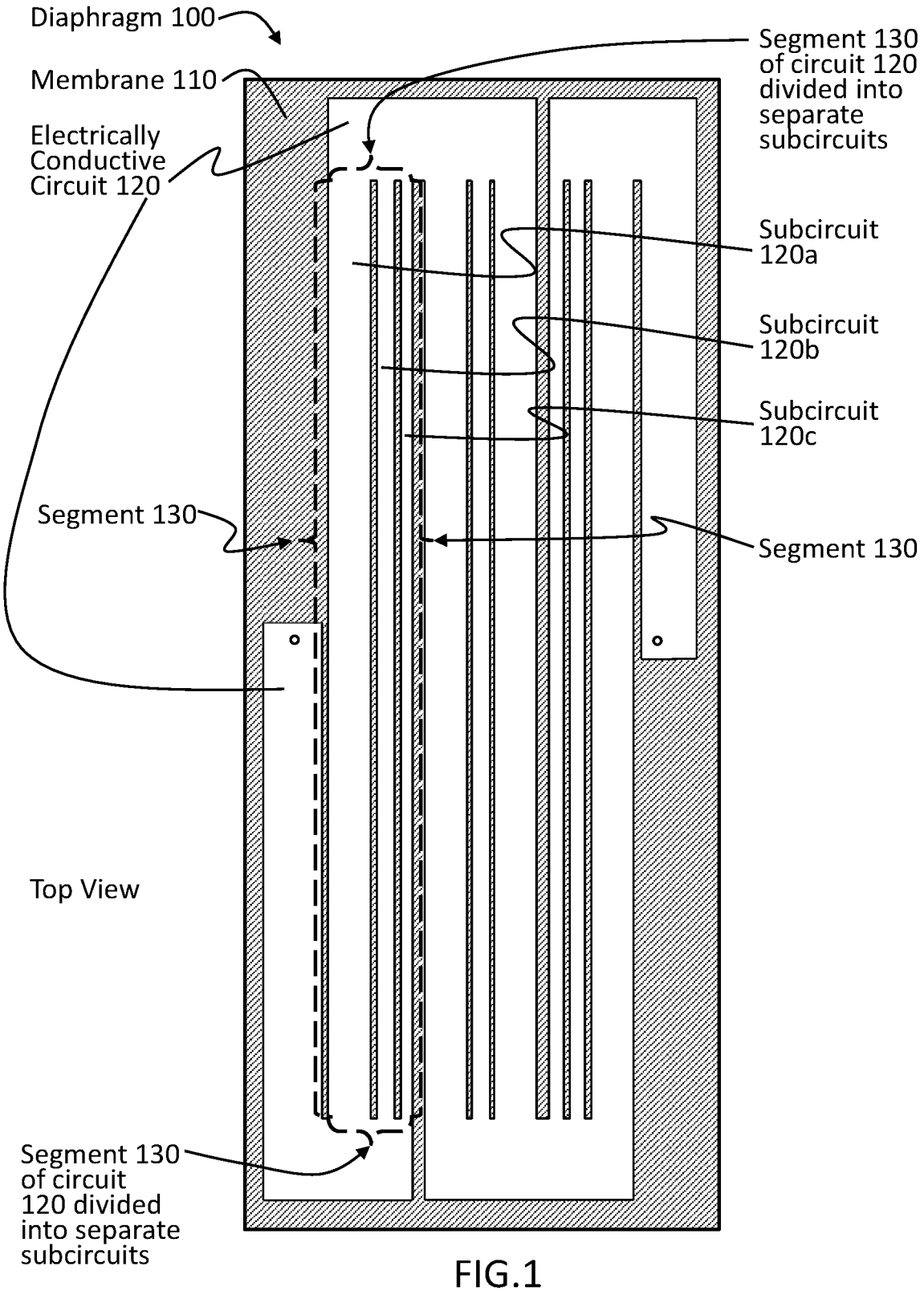
FIG. 1 is a diagram of a diaphragm 100 illustrating a single trace or electrically conductive circuit with three parallel subtraces or subcircuits as segments approximately covering a magnet bar length.

The present disclosure is susceptible to modifications and alternative forms, with representative embodiments shown by way of example in the drawings and described in detail below. Inventive aspects of this disclosure are not limited to the disclosed embodiments. Rather, the present disclosure is intended to cover alternatives falling within the scope of the disclosure as defined by the appended claims.

DETAILED DESCRIPTION

Embodiments of the present disclosure are described herein. It is to be understood, however, that the disclosed embodiments are merely examples, and that other embodiments can take various and alternative forms. The figures are not necessarily to scale. Some features may be exaggerated or minimized to show details of particular components. Therefore, specific structural and functional details disclosed herein are not to be interpreted as limiting, but merely as a representative basis for teaching one skilled in the art to variously employ the present disclosure.

Certain terminology may be used in the following description for the purpose of reference only, and thus are not intended to be limiting. For example, terms such as "above", "below", "top view", and "end view", refer to directions in the drawings to which reference is made. Terms such as "front," "back," "fore," "aft," "left," "right," "rear," and "side" describe the orientation and/or location of portions of the components or elements within a consistent but arbitrary frame of reference, which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

A planar magnetic transducer comprises a flat, lightweight diaphragm suspended in a magnetic field. The diaphragm in a planar magnetic transducer includes a conductive circuit pattern that, when energized, creates forces that move the diaphragm in the magnetic field to produce sound.

Problems arise because magnetic elements 180, both electro-magnetic and regular magnets, tend to produce irregular nonlinear magnetic fields and irregular nonlinear magnetic flux or magnetic force. One inventive solution is to match the irregularities and nonlinearities of a transducer's magnetic elements inversely with the irregularities and nonlinearities of the electromagnetic forces in the conductive circuit in the diaphragm. By inversely matching these irregularities and nonlinearities between the magnetic elements and the conductive circuits in diaphragms in small precise ways we can provide extremely linear conversion of the electric sound signal through a transducer into sound waves with extremely low distortion. By providing this capability in subcircuits or subtraces we can also control the respective impedances, currents, and Lorentz forces in the diaphragm, transducer, and audio device.

If the electrically conductive circuitry is uniform across the diaphragm, the diaphragm's movement will not be smooth due to the continuously varying magnetic flux density across the magnets. For example, where the attraction is stronger, the diaphragm will move more at that location, causing ripples in the movement of the diaphragm. Because the diaphragm movement generates a pressure wave that causes sound, ripples in the diaphragm movement will result in a distortion in the sound produced.

By inversely matching or correlating the flux density of the magnetic field in a planar magnetic speaker to subcircuit currents, a uniform force distribution is created across the diaphragm to avoid the undesired rippling in the diaphragm during sound production by the planar magnetic transducer.

While the examples herein are described in the context of a membrane or thin film with a circuit or subcircuit carried by, carried on, disposed on, or disposed within a diaphragm membrane of a planar magnetic speaker, any novel thin film circuits and/or the methods for manufacture may be applied herein to provide aspects. This includes but is not limited to any type of electroacoustic transducer, including speakers and microphones, arrays of microphones, arrays of speakers, fancy circuits, and multi layered circuits. Aspects are also applicable to loudspeakers, headphones, and in-ear earphones as well as to any other acoustic transducer.

Diaphragm material generally comprises a very thin substrate or membrane. A thin layer of conductive material is carried by, carried on, disposed on, affixed on, or adhered to the membrane on one or both sides. Alternatively, the conductive material is disposed within or inside the membrane or substrate itself. The electrically conductive circuit, material, layer, trace, subtrace, and/or subcircuit used in creating the conductive circuitry on or in the diaphragm include, but are not limited to, conductive materials and compositions thereof such as copper, aluminum, gold, silver, titanium, beryllium, carbon, tin, carbon nanotubes, nanoconductors, graphene, graphite, topological insulators, and/or superconductors.

The conductive material is disposed onto the substrate or membrane by lamination or other depositing processes on one or both faces. Alternatively, the conductive material is embedded in the material through other processes.

In some aspects, the depositing process includes the addition of an adhesive layer to bond the conductive material to the diaphragm substrate. In other aspects, the conductive material is bonded to the substrate without any layer of adhesive.

In some aspects, a laser or other etching techniques are used to selectively ablate or delaminate the conductive material on the thin films laminated with conductive material to create a circuit pattern that can be used to create a diaphragm for planar magnetic devices. However, the present invention is not limited to a specific manufacturing process or processes.

Referring to the drawings, wherein like reference numbers refer to the same or like components in the several Figures, FIG. 1 is a diagram of a top view of diaphragm 100 in a preferred embodiment comprising an electrically conductive circuit carried by membrane 110. Here, "carried by" as used with membrane 110 means that electrically conductive circuit 120 and/or subcircuits 120*a*, 120*b*, and/or 120*c* are disposed on, attached to, adhered to, affixed to, traced on, etched in, ablated, and/or embedded in membrane 110. In this example, a single trace or electrically conductive circuit 120 has three segments, such as segment 130 (see dashed lines) in series. Within segment 130 are subtraces or subcircuits as segments covering a magnet bar length or approximately a magnet bar length. In other aspects, the segment is a different length than the magnet. In some aspects, the segments and subcircuits are not straight. In some aspects the segments and/or subcircuits are curved or have other shapes. In some aspects the magnets are non-straight, curved, discs, discs within a cup, multiple rings, serpentine, or any other shapes.

In this preferred embodiment example, diaphragm 100 comprises an electrically conductive circuit 120 as traces or subcircuits on a membrane 110 or thin film membrane or substrate. In this example, the electrically conductive circuit 120 is divided into multiple segments of subcircuits. This example shows subcircuits 120*a*, 120*b*, and/or 120*c* as subcircuits of segment 130. However, in other aspects other numbers of subcircuits are allowed. In this example, segment 130 is a length or section of the electrically conductive circuit 120 which is divided into 3 separate subcircuits 120*a*, 120*b*, and/or 120*c*, as shown by the dashed lines outlining segment 130. In other aspects other numbers of segments are allowed. Segment 130 is an exemplary segment. Any number of segments 130 is allowed in the electrically conductive circuit 120. Any number of subcircuits equal to or greater than two is allowed in a segment such as segment 130. Subcircuits are not required to be of the same length in a segment. Segments are not required to be the same length as other segments. In some aspects, there are areas of the electrically conductive circuit 120 that are not required to be segments or subcircuits. In this example, a single trace or electrically conductive circuit 120 comprises a single trace. In other aspects, multiple traces or electrically conductive circuits 120 are carried by, disposed on, or embedded in the membrane 110 of diaphragm 100.

Figure 2:
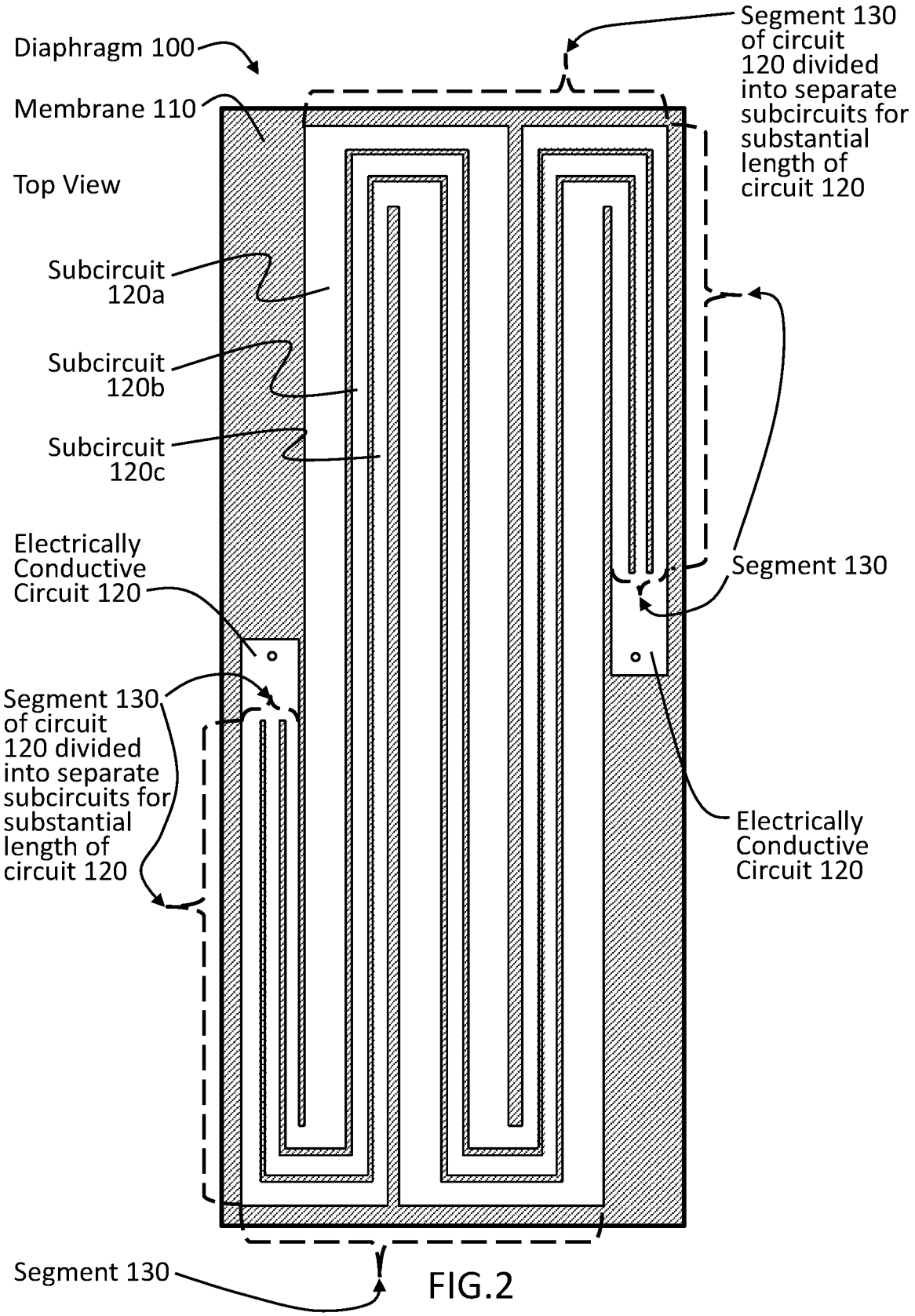
FIG. 2 is a diagram of a diaphragm 100 illustrating a single trace or electrically conductive circuit with three parallel subtraces or subcircuits covering a substantial length of the electrically conductive circuit.

FIG. 2 is a diagram of a top view of diaphragm 100 illustrating a single trace or electrically conductive circuit with three continuous parallel subtraces or subcircuits covering a substantial length of the electrically conductive circuit. In this example, electrically conductive circuit 120 is disposed on or in membrane 110 of diaphragm 100. In this example, segment 130 extends from one end of electrically conductive circuit 120 to the other end or substantially to the other end of the electrically conductive circuit 120. In this example, segment 130 is divided into separate subcircuits, such as 120*a*, 120*b*, and/or 120*c*, for a substantial length of electrically conductive circuit 120. Here, a substantial length means largely but not necessarily wholly, completely, or entirely. In this example, the very ends of the electrically conductive circuit 120 are shown as not being part of segment 130 and as not having subcircuits. However, in other aspects, the electrically conductive circuit 120 is composed completely of subcircuits, such as 120*a*, 120*b*, and/or 120*c*, with the ends of the subcircuits being joined at a point that is external to the diaphragm. In one aspect, a substantial length of the electrically conductive circuit 120 is defined to mean the entire length of the electrically conductive circuit 120. In one aspect, a substantial length of the electrically conductive circuit 120 is defined to mean the entire length of the electrically conductive circuit 120 except for the starting and ending points where the two or more separate subcircuits 120*a*, 120*b*, and/or 120*c* of the segment 130 are joined. In this example, the electrically conductive circuit 120 with a total current of $I_{120}$ (not shown) would take three different paths in subcircuits 120*a*, 120*b*, and 120*c*, such that $I_{120}=I_{120a}+I_{120b}+I_{120c}$ (not shown).

Figure 3:
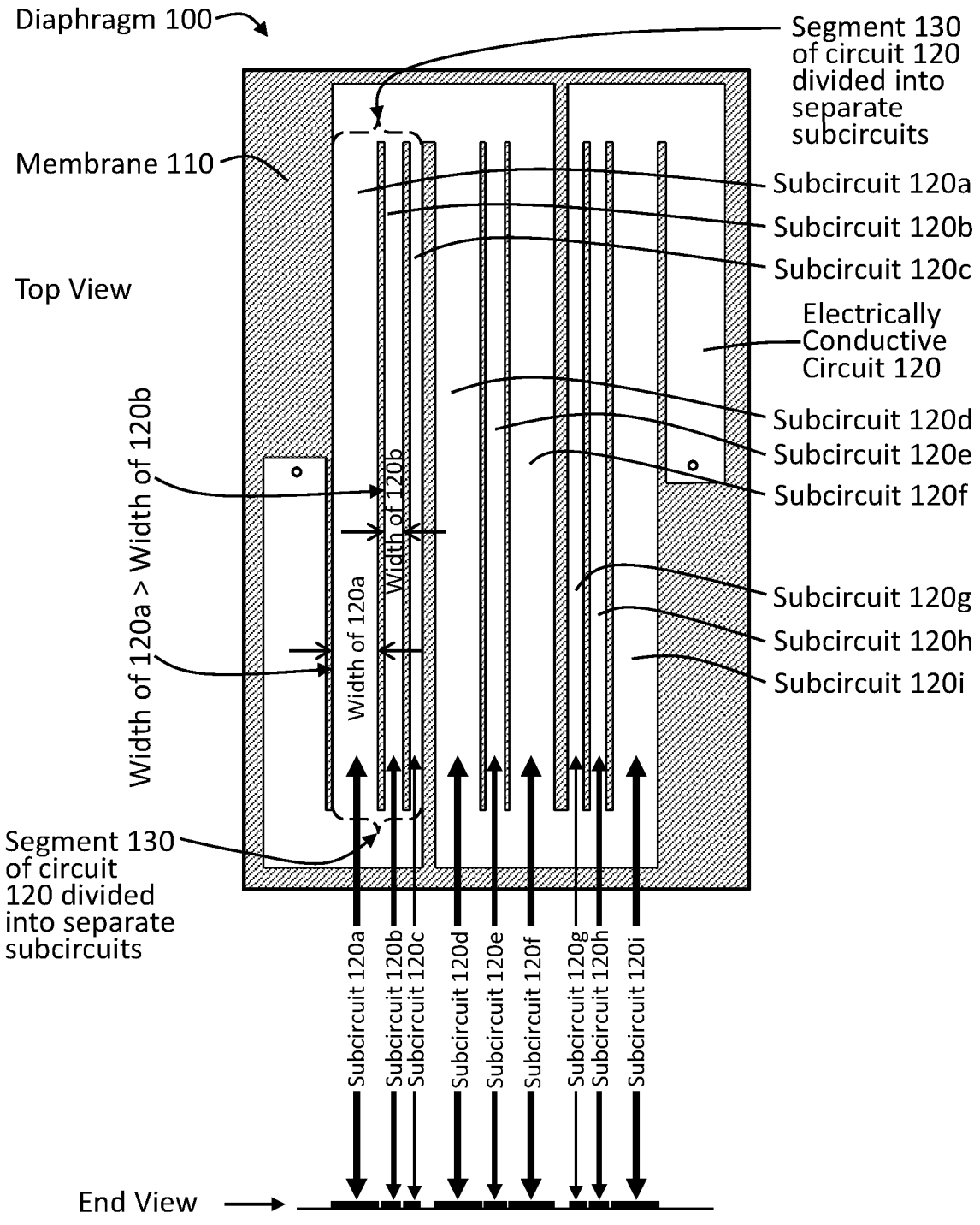
FIG. 3 is a diagram of a diaphragm 100 illustrating a single trace or electrically conductive circuit with separate subcircuits or subtraces having different width subtraces or subcircuits with the same or similar conductive thicknesses.

FIG. 3 is a diagram of a top view and end view of diaphragm 100 illustrating a single trace or electrically conductive circuit 120 with separate subcircuits or subtraces, such as subcircuits 120*a*, 120*b*, 120*c*, 120*d*, 120*e*, 120*f*, 120*g*, 120*h*, and/or 120*i*, with two or more separate subcircuits having different widths while having the same or similar conductive thicknesses. In this example, electrically conductive circuit 120 is disposed on or in membrane 110 of diaphragm 100. In this example, subcircuit 120*a*, subcircuit 120*b*, and subcircuit 120*c* are separate subcircuits of segment 130 (as shown by the dashed brackets), where the width of subcircuit 120*a* is larger or greater than the width of subcircuit 120*b*. The top of FIG. 3 shows a top view of the diaphragm 100, while the bottom of FIG. 3 illustrates an end view of the same diaphragm showing that two or more of the separate subcircuits 120*a*, 120*b*, 120*c*, 120*d*, 120*e*, 120*f*, 120*g*, 120*h*, and/or 120*i* have different widths, but the same or similar thicknesses.

Figure 4:
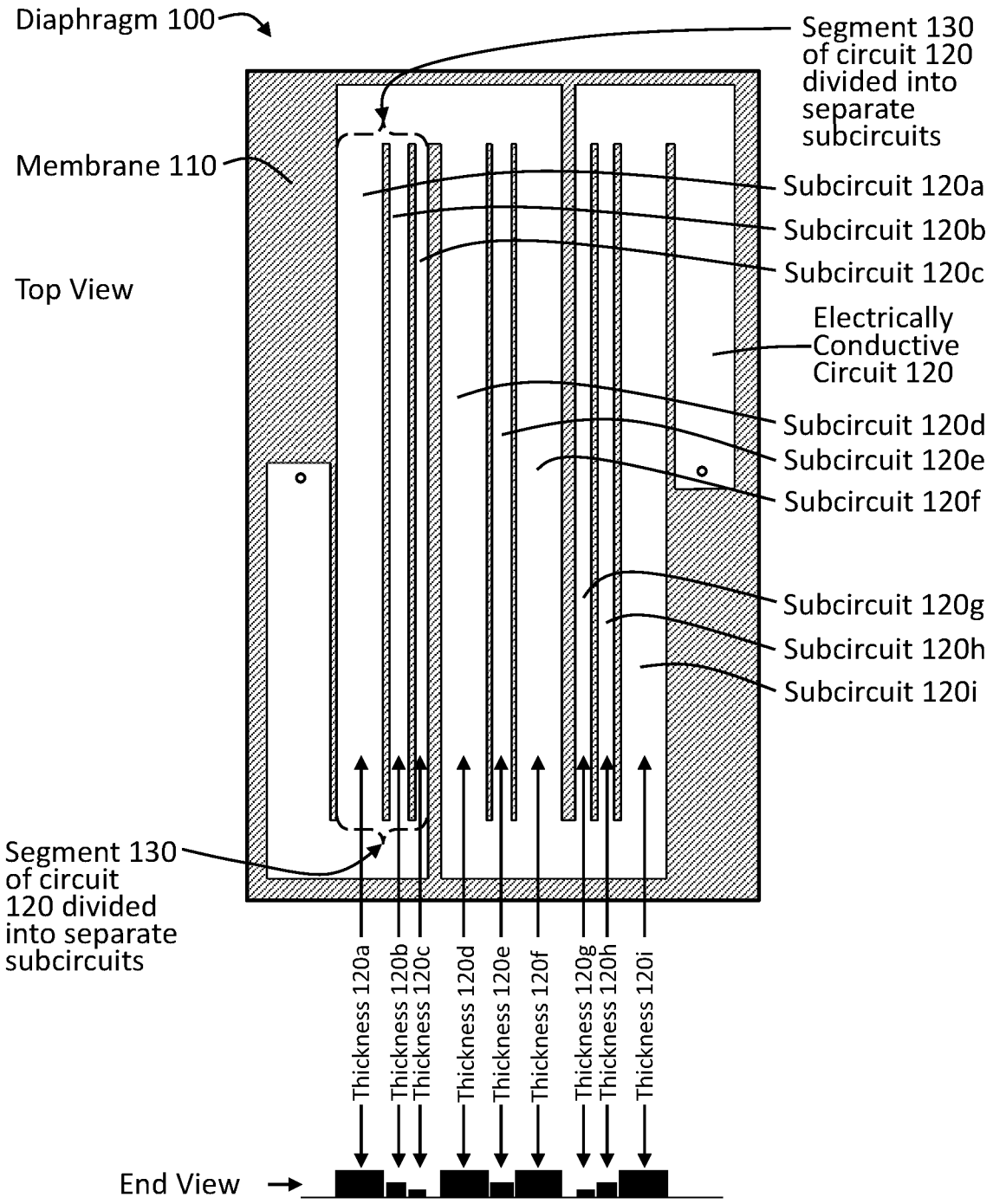
FIG. 4 is a diagram or illustration of a diaphragm 100 of a single trace or electrically conductive circuit with separate subcircuits or subtraces having different thicknesses of subtraces or subcircuits with different conductive widths.

FIG. 4 is a diagram of a top view and end view of diaphragm 100 illustrating a single trace or electrically conductive circuit 120 with separate subcircuits or subtraces, such as subcircuits 120*a*, 120*b*, 120*c*, 120*d*, 120*e*, 120*f*, 120*g*, 120*h*, and/or 120*i*, with two or more separate subcircuits having different widths while also having different conductive thicknesses. In this example, electrically conductive circuit 120 is disposed on or in membrane 110 of diaphragm 100. In this example, subcircuit 120*a*, subcircuit 120*b*, and subcircuit 120*c* are separate subcircuits of segment 130 (as shown by the dashed brackets), where the width of subcircuit 120*a* is larger or greater than the width of subcircuit 120*b* while subcircuit 120*a* is also thicker or deeper than subcircuit 120*b*. The top of FIG. 3 shows a top view of the diaphragm 100, while the bottom of FIG. 3 illustrates an end view of the same diaphragm showing that two or more of the separate subcircuits 120*a*, 120*b*, 120*c*, 120*d*, 120*e*, 120*f*, 120*g*, 120*h*, and/or 120*i* have different widths and different thicknesses. In other aspects, two or more subcircuits have the same widths and same thicknesses, or same widths and different thicknesses, or different widths and the same thicknesses, or different widths and different thicknesses. In one aspect, the thicknesses are normal or perpendicular to the membrane. In other aspects, the thicknesses or vertical dimensions of the electrically conductive circuit 120 or subcircuits 120*a*, 120*b*, 120*c*, 120*d*, 120*e*, 120*f*, 120*g*, 120*h*, and/or 120*i* are slanted, angled, non-normal, or non-perpendicular to the membrane.

Figure 5:
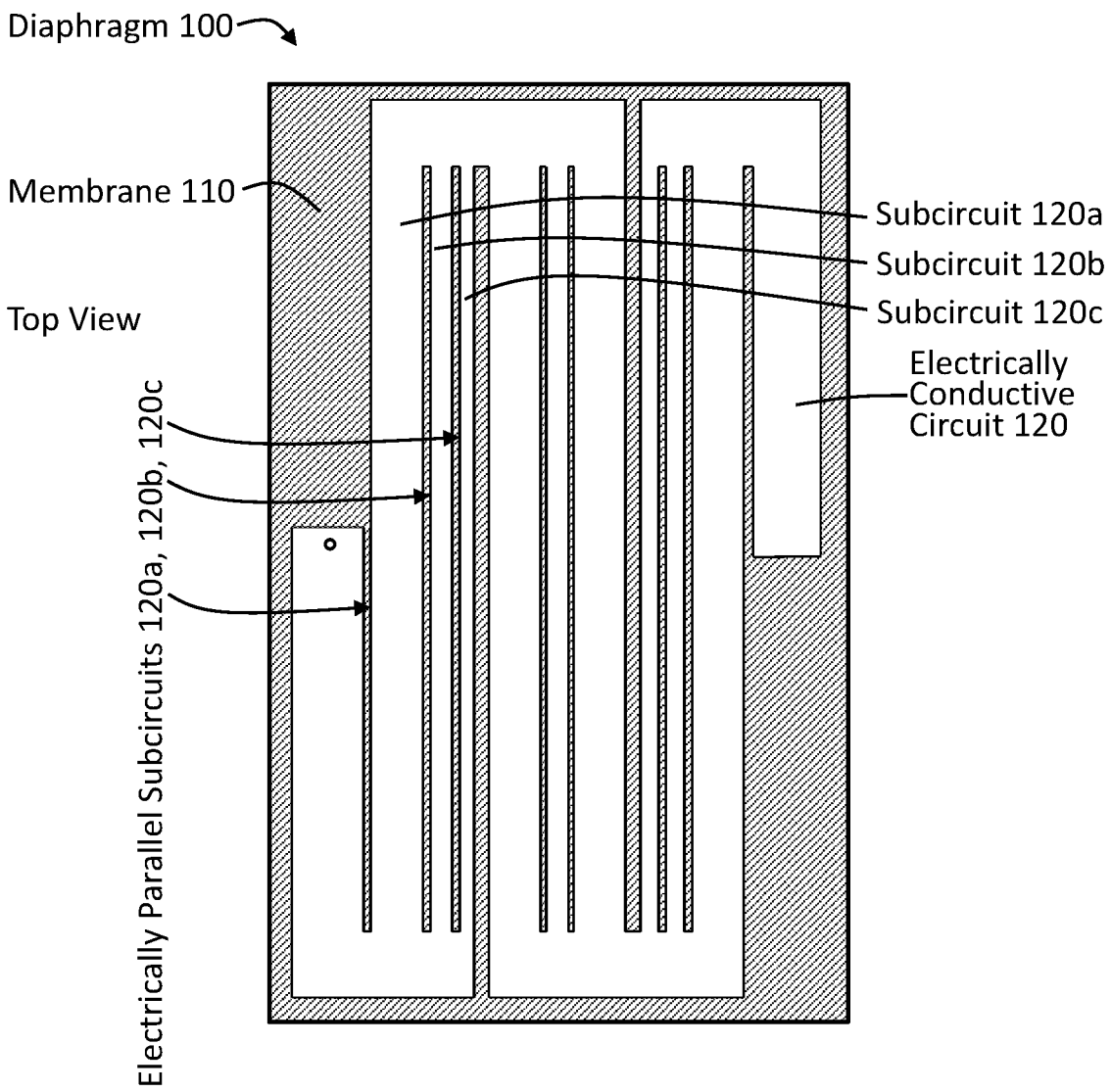
FIG. 5 is a diagram or illustration of a diaphragm 100 of a single trace or electrically conductive circuit with electrically parallel subcircuits or subtraces.

FIG. 5 is a diagram or illustration of a top view of a diaphragm 100 of a single trace or electrically conductive circuit 120 with electrically parallel subcircuits or subtraces such as subcircuits 120*a*, 120*b*, and 120*c*. In this example, electrically conductive circuit 120 is disposed on or in membrane 110 of diaphragm 100. In this example, in electrically conductive circuit 120, electrically parallel subcircuits or subtraces such as subcircuits 120*a*, 120*b*, and 120*c* are shown to be physically parallel. However, in other aspects not shown, electrically parallel subcircuits or subtraces such as subcircuits 120*a*, 120*b*, and 120*c* have other non-parallel physical shapes including, but not limited to, curved subcircuits, serpentine subcircuits, angled subcircuits, and other non-straight and non-parallel subcircuits. In other aspects, the subcircuits are also electrically non-parallel with potential for series, combinations, and cross-over circuits and subcircuits.

Figure 6:
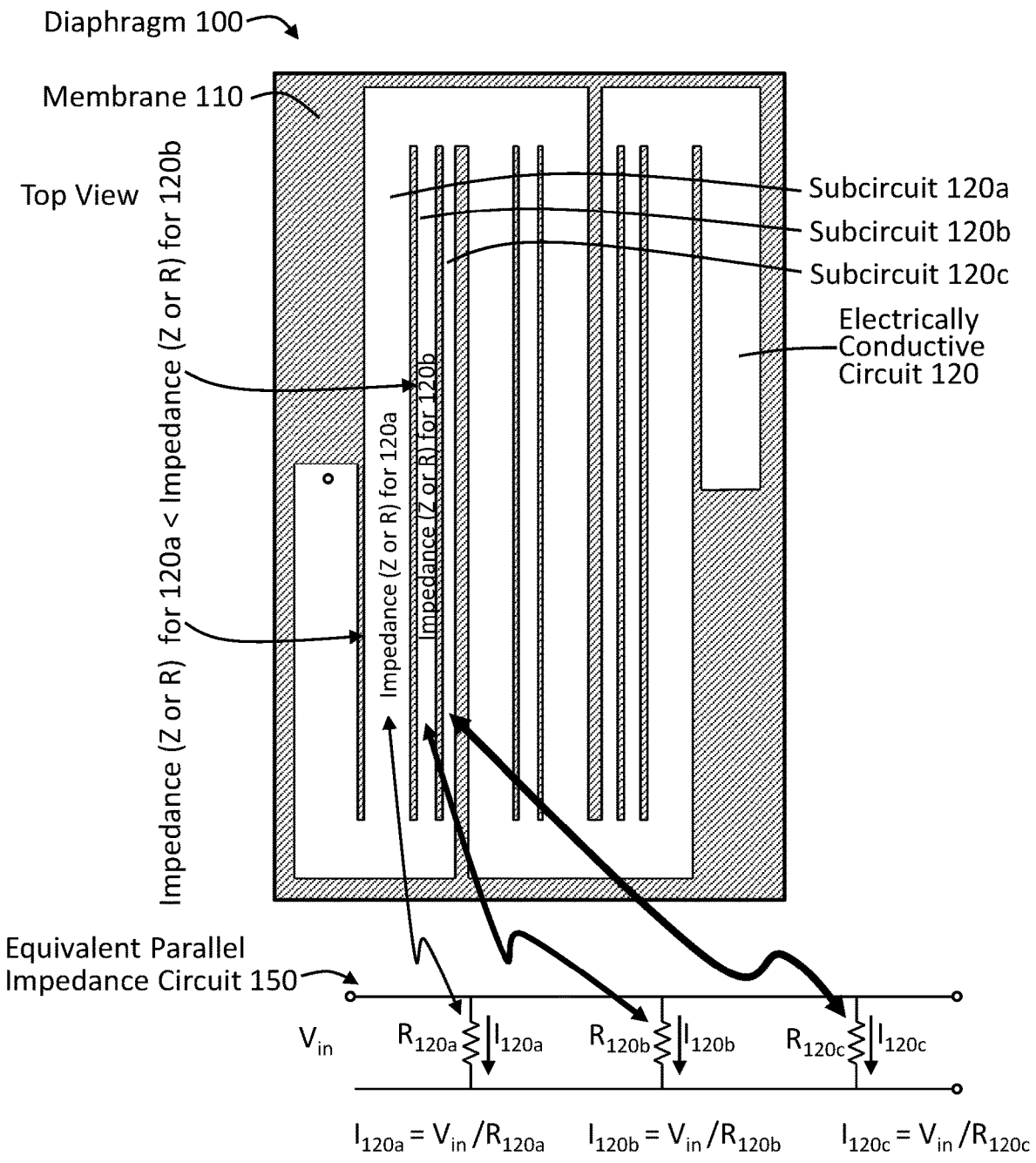
FIG. 6 is a diagram or illustration of a diaphragm 100 of a single trace or electrically conductive circuit with subcircuits or subtraces having different impedances or resistances showing the equivalent parallel impedance circuit 150 or parallel electrical impedance circuit.

FIG. 6 is a diagram or illustration of a top view and an electrical schematic of diaphragm 100 of a single trace or electrically conductive circuit 120 with subcircuits or subtraces such as subcircuits 120*a*, 120*b*, and 120*c* having different impedances or resistances for subcircuits 120*a*, 120*b*, and 120*c*. In this example, the terms impedance and resistance will be used interchangeably, but the subcircuits can be measured, calibrated, and designed using either resistance or impedance. In this example, electrically conductive circuit 120 is disposed on or in membrane 110 of diaphragm 100. In this example, the bottom of FIG. 6 shows the equivalent parallel impedance circuit 150 or parallel electrical impedance circuit for the subcircuits 120*a*, 120*b*, and 120*c* having impedances (Z) or resistances (R), here shown as Resistances (R) for $R_{120a}$, $R_{120b}$, and $R_{120c}$. Using the formula for impedance or resistance circuits, the bottom of FIG. 6 shows that separate currents for an input voltage $V_{in}$, is the sum of $I_{120a}=V_{in}/R_{120a}$; $I_{120b}=V_{in}/R_{120b}$; and $I_{120c}=V_{in}/R_{120c}$. In other aspects at least two or potentially many more separate subcircuits are electrically equivalent to at least two or potentially many more parallel impedance or resistance circuits.

Figure 7:
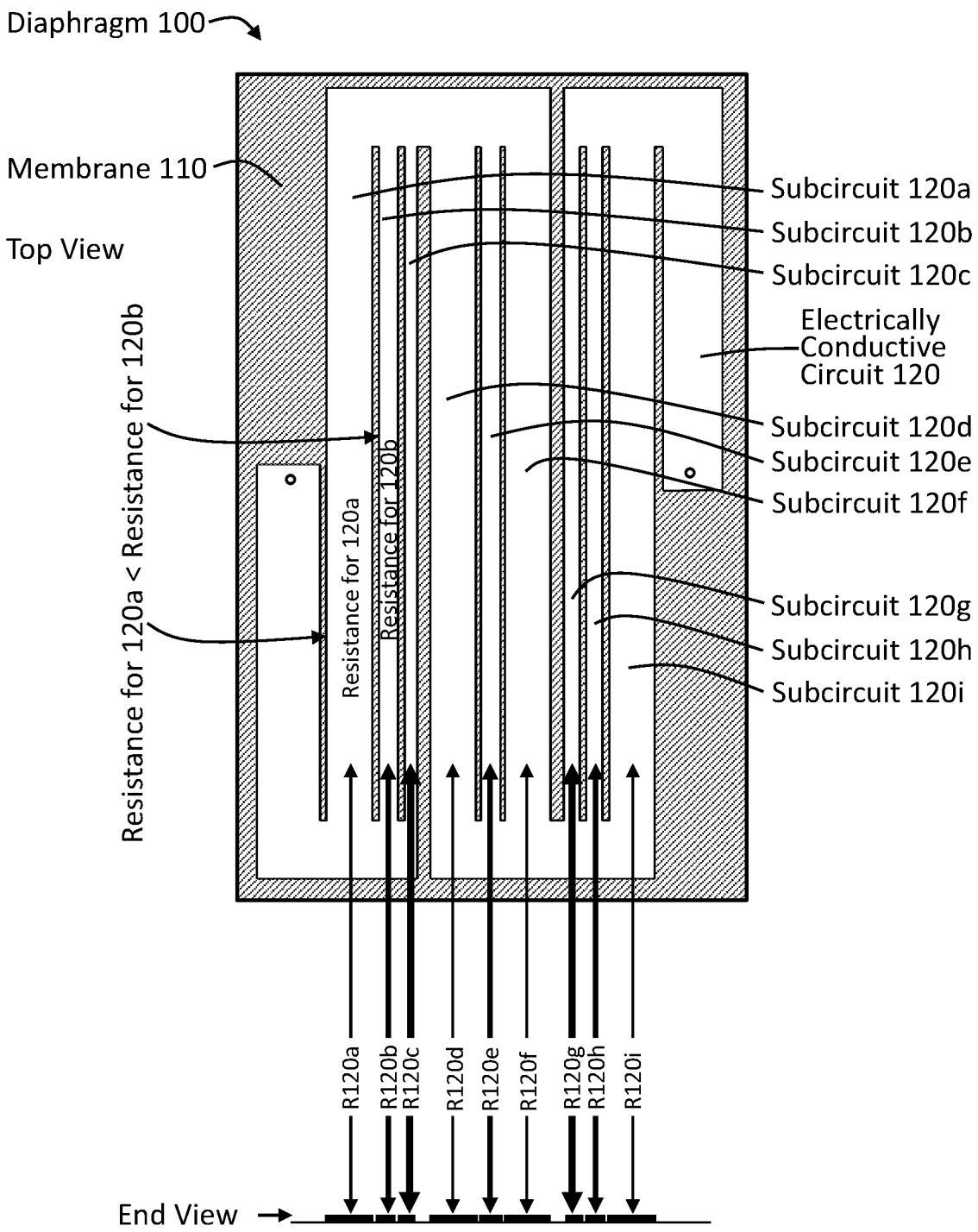
FIG. 7 is a diagram or illustration of a diaphragm 100 of a single trace or electrically conductive circuit with electrically parallel subcircuits or subtraces having different impedances or resistances showing that some wider circuits of the same thicknesses have lower electrical resistance.

FIG. 7 is a diagram or illustration of a top view and end view of diaphragm 100 for a single trace or electrically conductive circuit 120 with subcircuits 120*a*, 120*b*, 120*c*, 120*d*, 120*e*, 120*f*, 120*g*, 120*h*, and/or 120*i* or subtraces having different impedances or resistances $R_{120a}$, $R_{120b}$, $R_{120c}$, $R_{120d}$, $R_{120e}$, $R_{120f}$, $R_{120g}$, $R_{120h}$, and/or $R_{120i}$. This example shows that some wider subcircuits 120*a* and 120*b* of the same thicknesses have lower electrical resistance.

Figure 8:
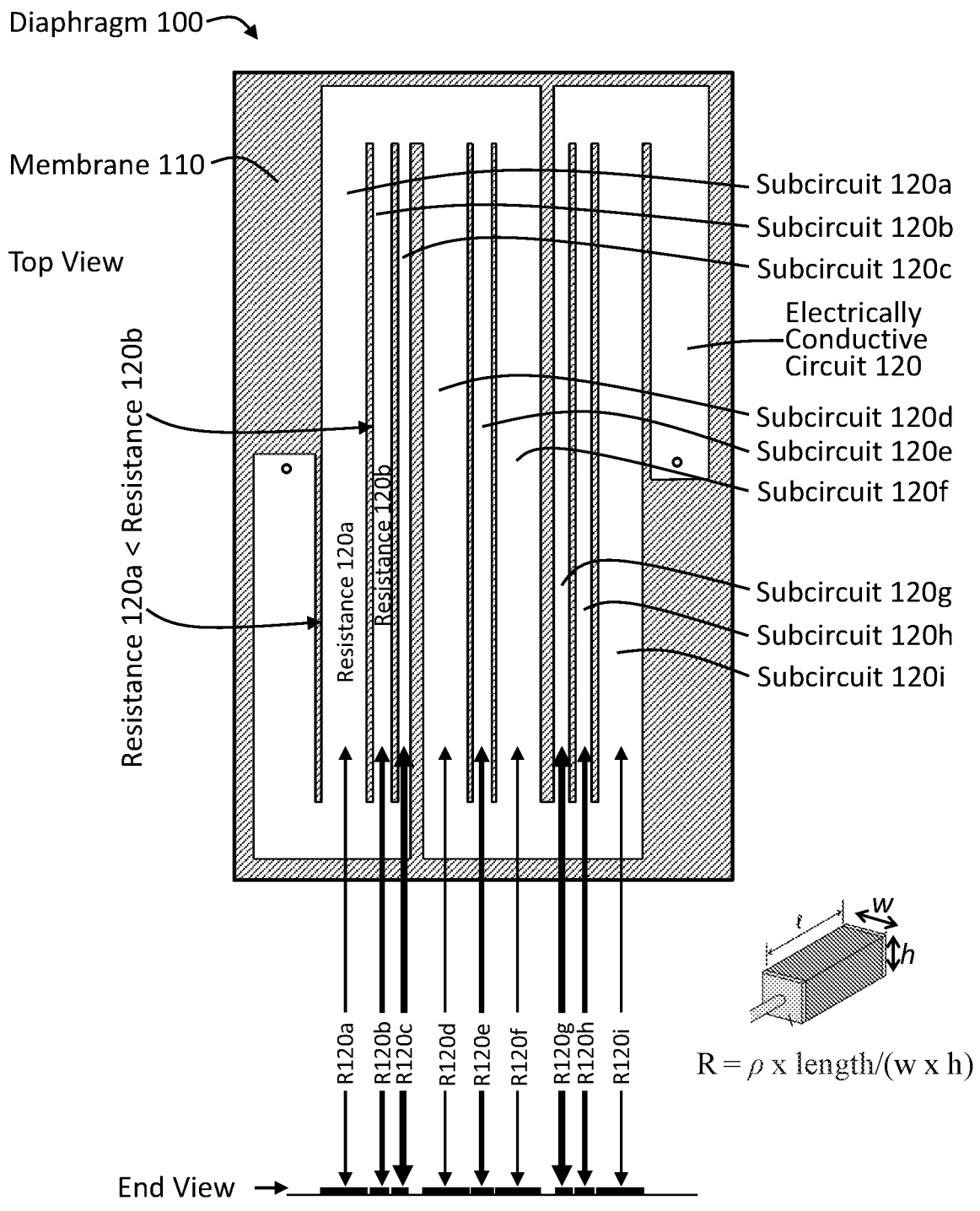
FIG. 8 is a diagram or illustration of a diaphragm 100 of a single trace or electrically conductive circuit with electrical subcircuits or subtraces having different impedances or resistances showing that electrical resistance or impedance is affected by the length, width, height or thickness, and the specific resistivity p (rho).

FIG. 8 is a diagram or illustration of a top view and end view of diaphragm 100 for a single trace or electrically conductive circuit 120 with electrical subcircuits such as 120*a*, 120*b*, 120*c*, 120*d*, 120*e*, 120*f*, 120*g*, 120*h*, and/or 120*i* or subtraces having different impedances or resistances showing that electrical resistance or impedance is affected by the length, width, height, thickness, and/or the specific resistivity p (rho). FIG. 8 shows a 3D illustration in the bottom right corner illustrating that resistance R is determined by the specific resistivity ρ (rho) of the material, as well as the length (which increases resistance), and the area (width×height which decreases resistance). In other aspects, resistance can be determined by using different shapes (e.g., serpentine), which affects the other resistance parameters.

Figure 9:
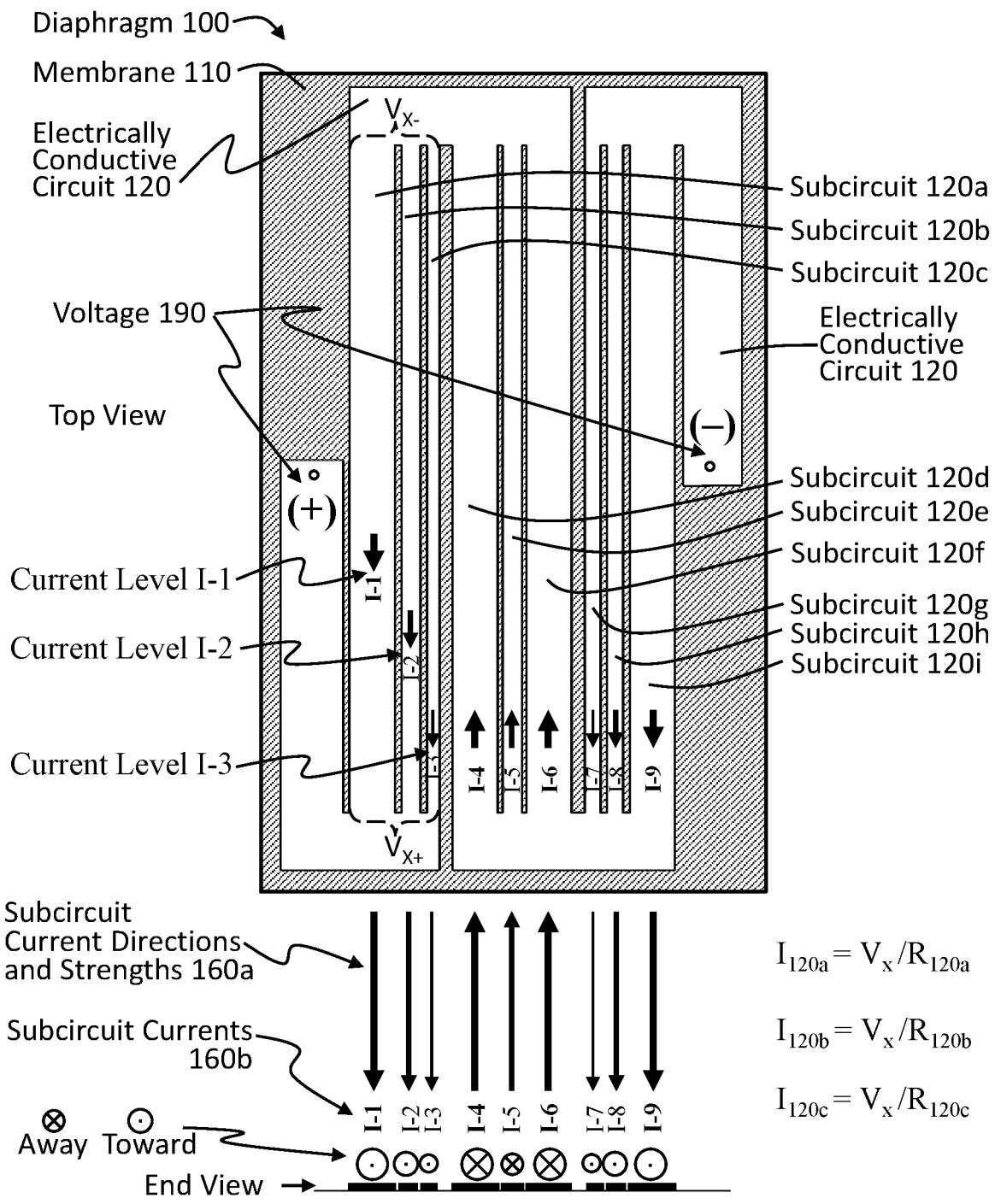
FIG. 9 is a diagram or illustration of a diaphragm 100 of a single trace or electrically conductive circuit with electrical subcircuits or subtraces having a voltage applied across the electrically conductive circuit and/or subcircuits showing different possible current directions and different possible current levels, including the top views and end views.

FIG. 9 is a diagram or illustration of the top view and end view of diaphragm 100 for a single trace or electrically conductive circuit 120 with electrical subcircuits such as 120*a*, 120*b*, 120*c*, 120*d*, 120*e*, 120*f*, 120*g*, 120*h*, and/or 120*i* or subtraces having a voltage 190 applied across the electrically conductive circuit 120 in its entirety (Voltage 190) and subcircuits 120*a*, 120*b*, 120*c*, 120*d*, 120*e*, 120*f*, 120*g*, 120*h*, and/or 120*i*, which generates currents in different directions and different levels in the subcircuits. In this example, the top view is labeled with the different currents and current levels such as I-1, I-2, I-3, I-4, I-5, I-6, I-7, I-8, and I-9. In this example, $V_{X-}$ and $V_{X+}$ (as indicated by the dashed bracket lines) indicate the voltage drop $V_X$ that occurs across subcircuits 120*a*, 120*b*, and 120*c*. This voltage $V_X$ causes, generates, forces, motivates, and/or pressures different currents I-1, I-2, and I-3 to flow in the subcircuits 120*a*, 120*b*, and 120*c*, depending upon the different resistances in the subcircuits (see FIGS. 6, 7, and 8 for explanations of resistances and impedances). In this example, these currents (I-1, I-2, and I-3) and current levels are mapped with the down-pointing vertical arrows as subcircuit current directions and strengths 160*a* and subcircuit currents 160*b*. These illustrate the end view at the bottom of the figure, which shows the widths of the subcircuits, and the direction and intensity of the different currents. At the bottom of the figure, the circles with the Xs in them indicate that the current is flowing away from the viewer, while the circles with the dots in them indicate that the current is flowing toward the viewer. The widths of the subcircuits are shown at the bottom of the figure, wherein the wider widths (which have less resistance) show immediately above the width a larger circle indicating a higher flow of current. Conversely, where the width of the subcircuit is narrower (which has more resistance) there shows immediately above the narrower subcircuit a smaller arrow indicating that the current is smaller due to the larger resistance. In this example, the formulas are shown in the lower right of the figure for each of the currents $I_{120a}$, $I_{120b}$, and $I_{120c}$ in subcircuits 120*a*, 120*b*, and 120*c*, where $V_X$ is the voltage that is applied across the subcircuits 120*a*, 120*b*, and 120*c*. In other aspects, a multitude of different subcircuit designs are possible, each of which affects the resistances, impedances, and currents in the subcircuits.

Figure 10A:
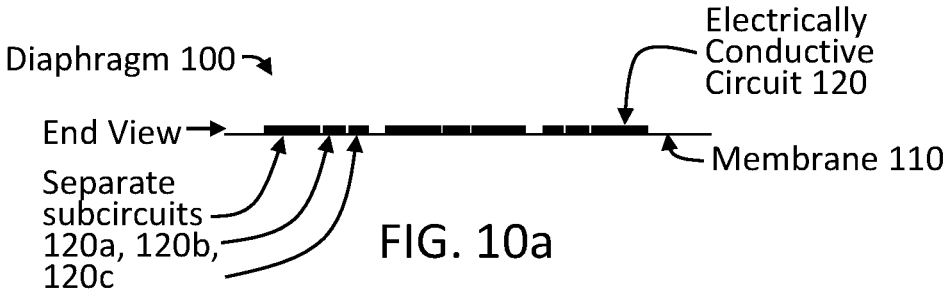
FIG. 10*a* is a diagram or illustration of the end view of a diaphragm 100 of a single trace or electrically conductive circuit having electrical subcircuits or subtraces disposed on the top side of the membrane.
Figure 10B:
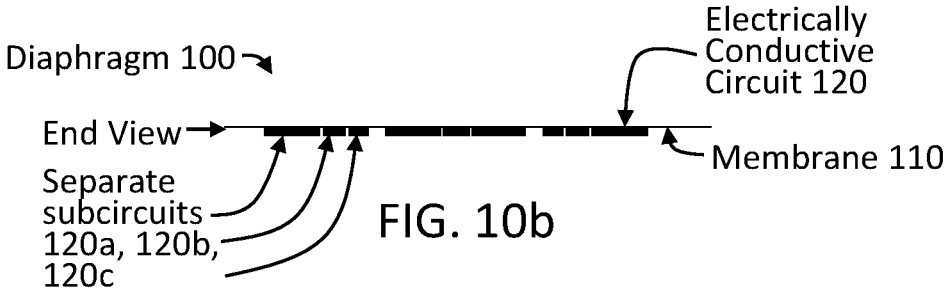
FIG. 10*b* is a diagram or illustration of the end view of a diaphragm 100 of a single trace or electrically conductive circuit having electrical subcircuits or subtraces disposed on the bottom side of the membrane.
Figure 10C:
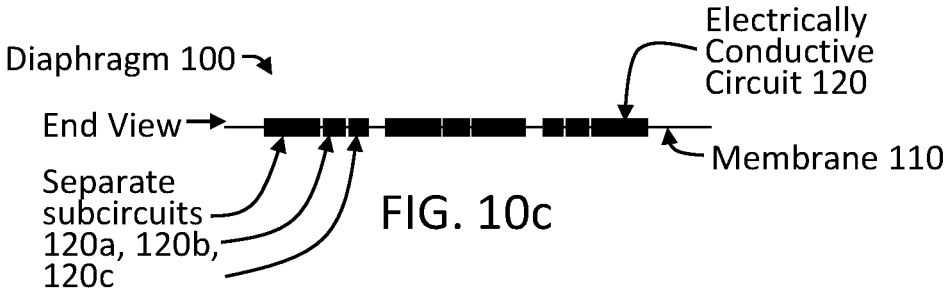
FIG. 10*c* is a diagram or illustration of the end view of a diaphragm 100 of a single trace or electrically conductive circuit having electrical subcircuits or subtraces disposed on both sides of the membrane.
Figure 10D:
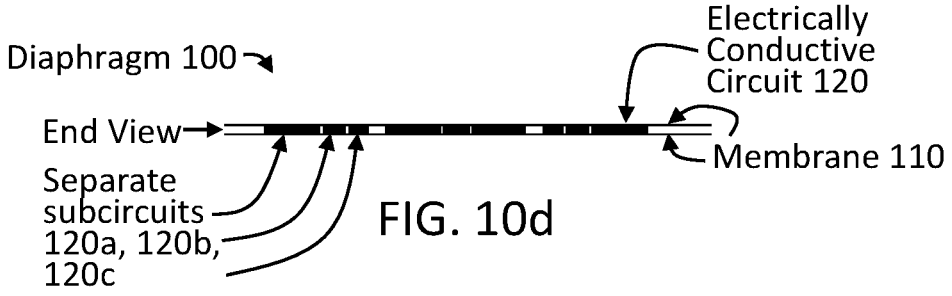
FIG. 10*d* is a diagram or illustration of the end view of a diaphragm 100 of a single trace or electrically conductive circuit having electrical subcircuits or subtraces disposed inside the membrane.

FIG. 10*a* is a diagram or illustration of the end view of a diaphragm 100 for a single trace or electrically conductive circuit 120 having electrical subcircuits such as subcircuits 120*a*, 120*b*, and/or 120*c* or subtraces disposed on the top side of the membrane. FIG. 10*b* is a diagram or illustration of the end view of a diaphragm 100 for a single trace or electrically conductive circuit 120 having electrical subcircuits such as subcircuits 120*a*, 120*b*, and/or 120*c* or subtraces disposed on the bottom side of the membrane. FIG. 10*c* is a diagram or illustration of the end view of a diaphragm 100 having a single trace or electrically conductive circuit 120 having electrical subcircuits such as subcircuits 120*a*, 120*b*, and/or 120*c* or subtraces disposed on both sides of the membrane. FIG. 10*d* is a diagram or illustration of the end view of a diaphragm 100 with a single trace or electrically conductive circuit 120 having electrical subcircuits such as subcircuits 120*a*, 120*b*, and/or 120*c* or subtraces disposed inside the membrane.

Figure 11:
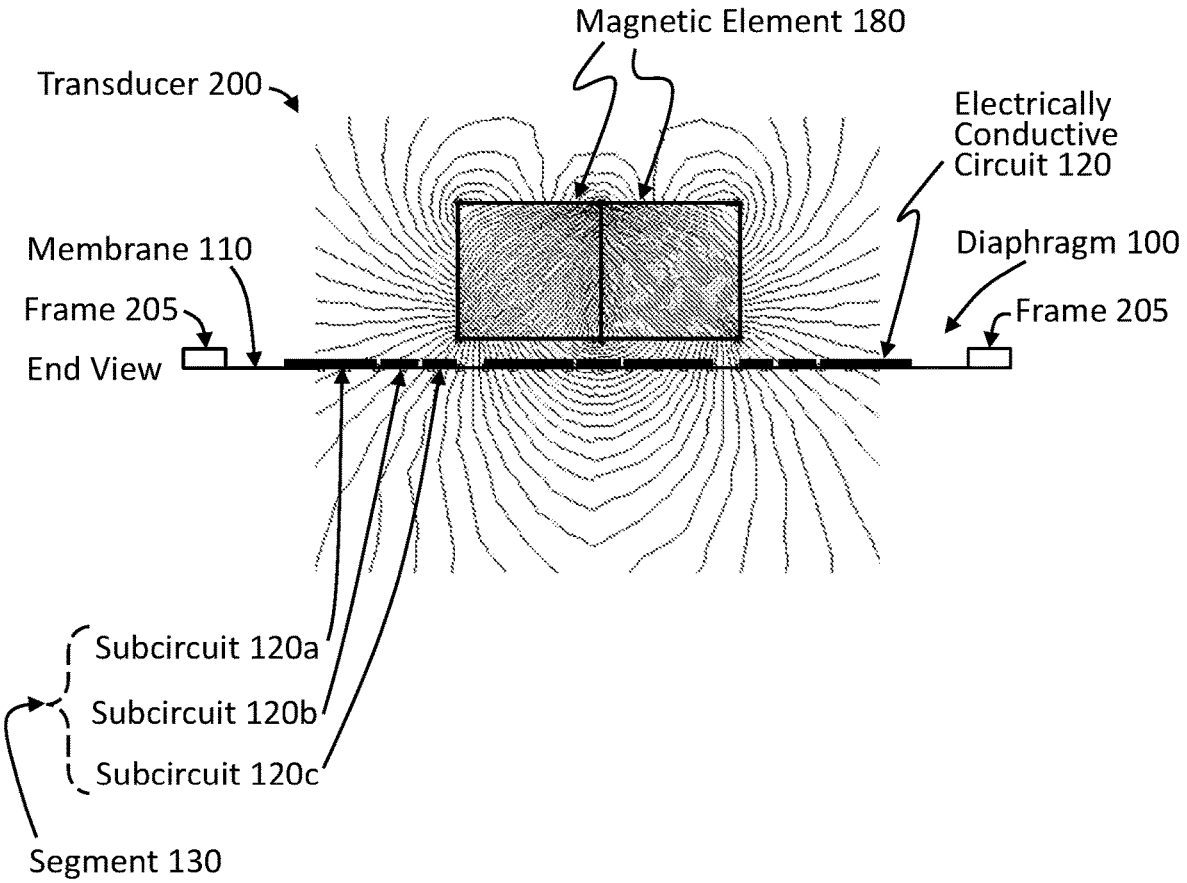
FIG. 11 is a diagram or illustration of the end view of a transducer 200 having a diaphragm with a single trace or electrically conductive circuit having electrical subcircuits or subtraces disposed on the membrane, the diaphragm having a frame 205, and a magnetic element 180 adjacent the diaphragm.

FIG. 11 is a diagram or illustration of the end view of a transducer 200 having a diaphragm 100 with a single trace or electrically conductive circuit 120 including a segment 130 divided into electrical subcircuits such as 120*a*, 120*b*, and 120*c* carried by (meaning disposed on, affixed to, adhered to, supported by, and/or embedded in) a membrane 110. In this example, the diaphragm 100 for transducer 200 is as shown and described, but not limited to, FIGS. 1, 3, 4, 5, 6, 7, 8, 9, and 10. In this example, the diaphragm has a frame 205 which is rigid or semi-rigid for support and a magnetic element 180 adjacent the diaphragm. In this example, frame 205 is shown supporting the diaphragm 100 by the membrane 110. In other aspects, another type of support is used such as an acoustic housing, a mounting bracket, a printed circuit board (PCB), a magnet or a magnet structure, all of which are considered to be the equivalent of frame 205 for supporting the diaphragm 100. In this example, the magnetic element 180 is shown disposed adjacent the diaphragm. In other aspects, the magnetic element 180 is disposed in other positions with respect to the diaphragm 100, the electrically conductive circuit 120, and/or the subcircuits such as 120*a*, 120*b*, and/or 120*c*. For example, the magnetic element 180 is not required to be the shape shown. In other aspects, the magnetic element is another shape or form or material or has different shaped magnetic flux lines thus enabling different locations and different methods of disposition with respect to the diaphragm 100, the electrically conductive circuit 120, and/or the subcircuits such as 120*a*, 120*b*, and/or 120*c*. In this example, the magnetic element 180 is a single angled magnetic pair array (Fluxor®) or diagonally magnetized magnets as described in U.S. Pat. No. 9,287,029. In other aspects the magnetic element 180 is an electromagnet or some other form of magnet. In other aspects the disposition of the magnetic element 180 is the frame 205 or another type of support mechanism such as an acoustic housing, a mounting bracket, a printed circuit board (PCB), a magnet frame, or a magnet structure, all of which are considered to be the support and/or disposition of the magnetic element 180.

Figure 12:
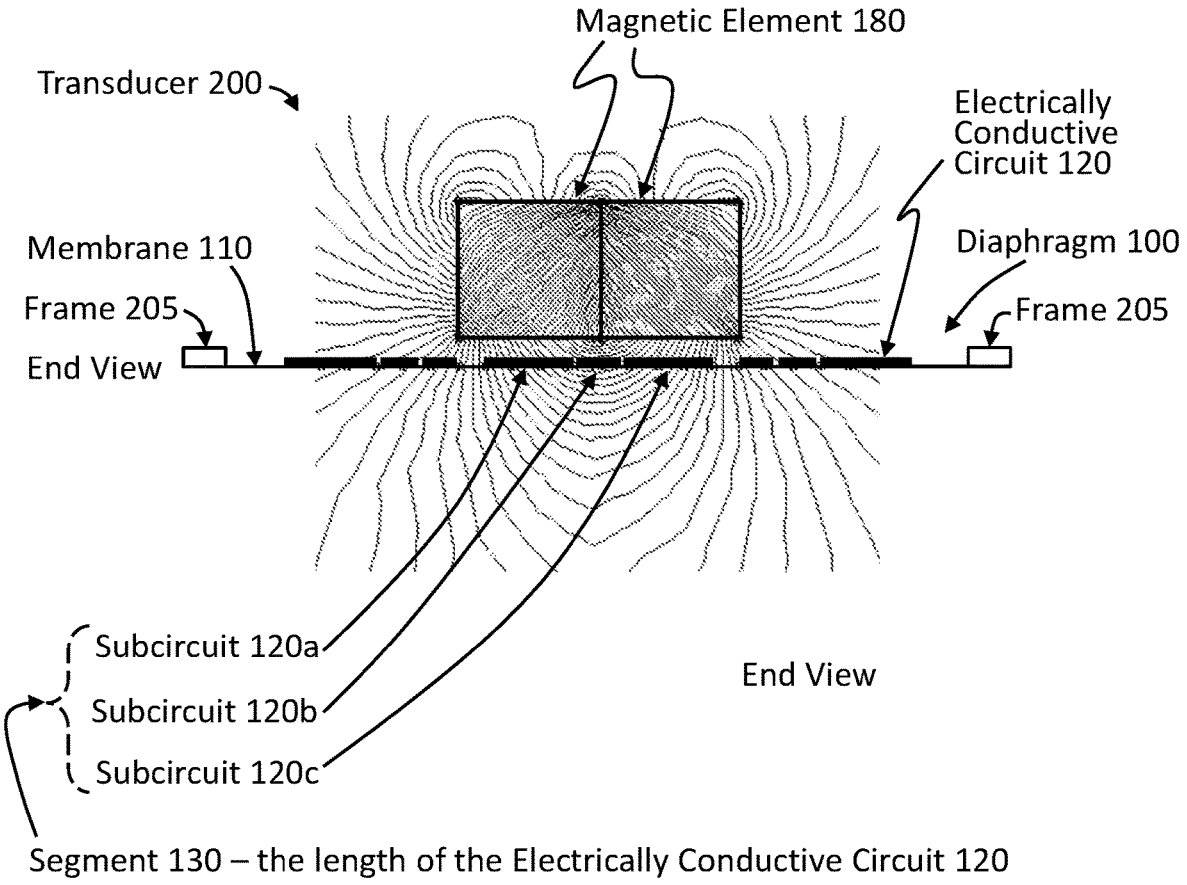
FIG. 12 is a diagram or illustration of the end view of a transducer 200 having a diaphragm with a single trace or electrically conductive circuit having electrical subcircuits or subtraces disposed on the membrane, the diaphragm having a frame 205, and a magnetic element 180 of angled magnetic pair magnets or diagonally magnetized magnets adjacent the diaphragm, where the segment 130 is the length of the electrically conductive circuit.

FIG. 12 is a diagram or illustration of the end view of a transducer 200 having a diaphragm as shown and described, but not limited to, FIG. 2 with a single trace or electrically conductive circuit 120 having electrical subcircuits or subtraces such as 120*a*, 120*b*, and 120*c* carried by (meaning disposed on, affixed to, adhered to, supported by, and/or embedded in) a membrane 110. In this example, the diaphragm has a frame 205, and a magnetic element 180 of angled magnetic pair magnets or diagonally magnetized magnets adjacent the diaphragm, where the segment 130 is substantially the length of the electrically conductive circuit. In this example, segment 130 comprises a substantial length of subcircuits 120*a*, 120*b*, and 120*c*. In this example, a substantial length of the electrically conductive circuit 120 or subcircuits 120*a*, 120*b*, and 120*c* is defined to mean a large length of or most of the length of the electrically conductive circuit 120 or subcircuits 120*a*, 120*b*, and 120*c*, but not necessarily the whole or the entire length of the electrically conductive circuit 120 or subcircuits 120*a*, 120*b*, and 120*c*. In other aspects, a substantial length of the electrically conductive circuit 120 is defined to mean the entire length of the electrically conductive circuit 120 and the subcircuits 120*a*, 120*b*, and 120*c*. In other aspects, multiple electrically conductive circuits 120 are carried by the membrane 110 including subcircuits such as 120*a*, 120*b*, and/or 120*c*.

Figure 13:
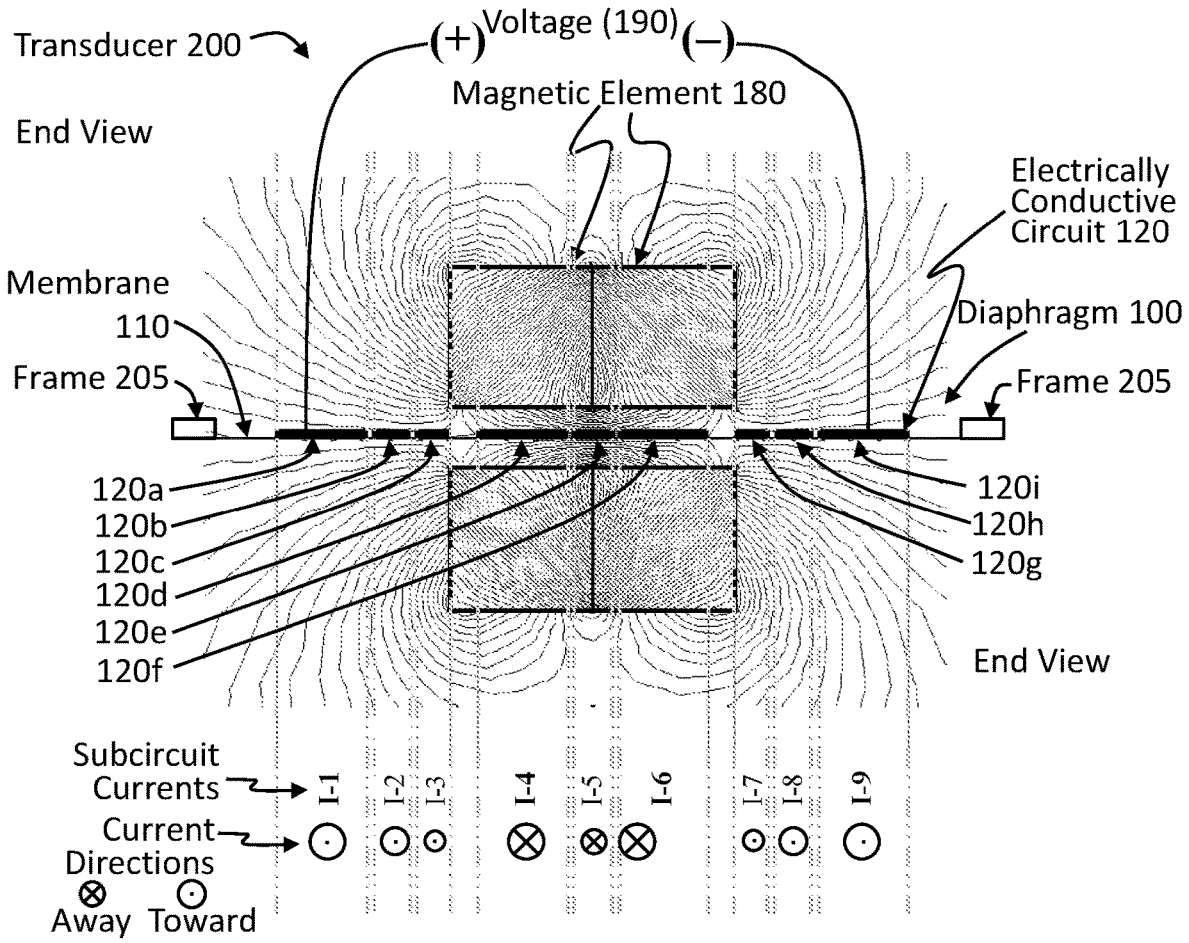
FIG. 13 is a diagram or illustration of the end view or cross-section of a transducer 200 having a diaphragm with a single trace or electrically conductive circuit having electrical subcircuits or subtraces disposed on the membrane, the diaphragm having a frame 205, and a magnetic element 180 of angled magnetic pair magnets or diagonally magnetized magnets on both sides of the diaphragm, where each subcircuit shows a current direction and relative current intensity or level.

FIG. 13 is a diagram or illustration of the end view and electrical current view of a transducer 200 having a diaphragm 100 with a single trace or electrically conductive circuit 120 with electrical subcircuits such as 120*a*, 120*b*, 120*c*, 120*d*, 120*e*, 120*f*, 120*g*, 120*h*, and/or 120*i* or subtraces disposed on or in the membrane. In this example, the diaphragm has a frame 205, and a magnetic element 180 of angled magnetic pair magnets or (Fluxor®) magnets or diagonally magnetized magnets as described in U.S. Pat. No. 9,287,029 mounted or disposed on both sides of the diaphragm. At the bottom of FIG. 13 is an indicator of the different currents flowing through the subcircuits 120*a*, 120*b*, 120*c*, 120*d*, 120*e*, 120*f*, 120*g*, 120*h*, and/or 120*i* where each subcircuit shows a current direction and relative current intensity or level. As shown and described in FIG. 9, at the bottom of FIG. 13 the circles with the Xs in them indicate that the current is flowing away from the viewer, while the circles with the dots in them indicate that the current is flowing toward the viewer, as shown on the key in FIG. 15. The widths of the subcircuits are shown at the bottom of the figure, wherein the wider widths (which have less resistance) show immediately above the width a larger circle indicating a higher flow of current. Conversely, where the width of the subcircuit is narrower (which has more resistance) there shows immediately above the narrower subcircuit a smaller arrow indicating that the current is smaller due to the larger resistance.

Figure 14A:
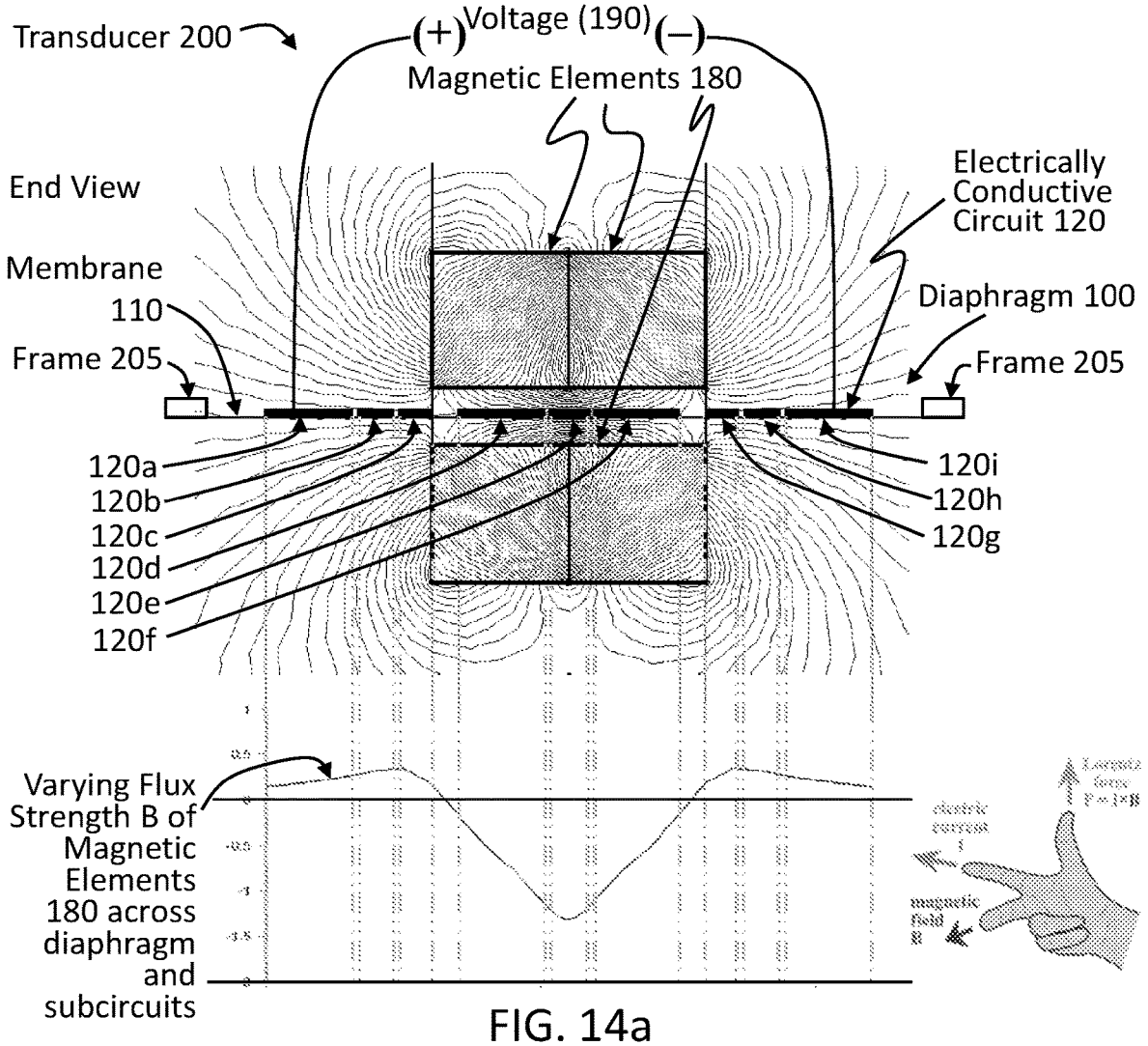
FIG. 14*a* is a diagram or illustration of the end view or cross-section of a transducer 200 from FIG. 13, including a graph of the varying flux strength (B) or flux density of the magnetic element 180 with respect to the magnetic fields across the diaphragm 100.

FIG. 14*a* is a diagram or illustration of the end view of a transducer 200 from FIG. 13, including a graph of the varying flux strengths (B) or flux densities of the magnetic element 180 with respect to the magnetic fields across the diaphragm 100. In this example, the graph at the bottom of FIG. 14*a* and the dashed lines from the diaphragm shows the correlation of the magnetic flux strengths also called flux densities (both positive and negative) that are interacting with the subcircuits 120*a*, 120*b*, 120*c*, 120*d*, 120*e*, 120*f*, 120*g*, 120*h*, and 120*i* in the diaphragm 100.

Figure 14B:
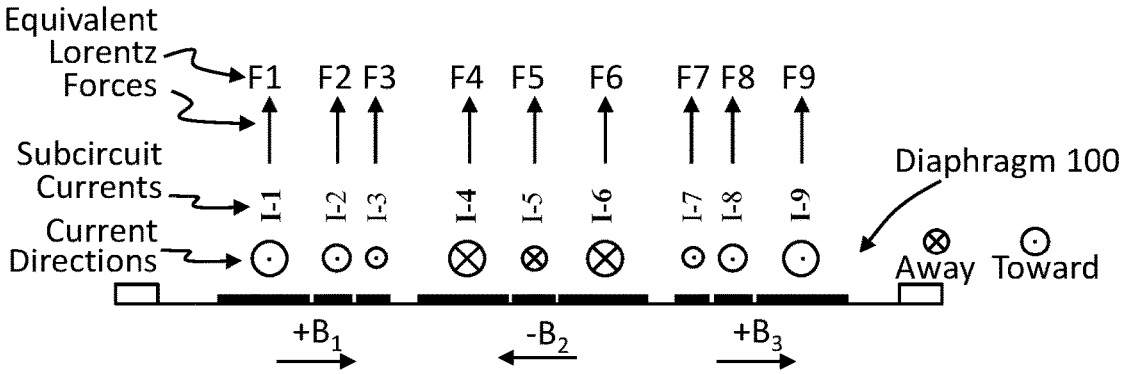
FIG. 14*b* shows the equivalent Lorentz forces that are generated when the different flux strengths (B) or flux densities interact with the different current levels and directions in the subcircuits. Note that the subcircuit currents correlate to, inversely correlate to, or are inversely proportional to the flux strength (B) or flux density to result in similar or equivalent Lorentz forces.

FIG. 14*b* at the bottom shows the relative current strengths and directions such as I-1, I-2, I-3, I-4, I-5, I-6, I-7, I-8, and I-9 that flow in subcircuits 120*a*, 120*b*, 120*c*, 120*d*, 120*e*, 120*f*, 120*g*, 120*h*, and 120*i* when a voltage is applied across electrically conductive circuit 120. Note that the current strengths I-1, I-2, I-3, I-4, I-5, I-6, I-7, I-8, and I-9 in the subcircuits correlate inversely to the flux strengths (B) (also called flux densities) in the graph in FIG. 14*a*. In the lower right of FIG. 14*a* is a drawing of the right-hand rule, which shows that the Lorentz force F=the magnetic field strength (B) from the graph multiplied times the electric current I. Since F is proportional to I×B (assuming the subcircuits have similar lengths), a strong current I can be matched to a weak magnetic field B and result in a similar Lorentz force F as a weak current I matched to a strong magnetic field B.

Thus, the top of FIG. 14*b* shows the similar or equivalent Lorentz forces (F1, F2, F3, F4, F5, F6, F7, F8, F9) that are generated when the different flux strengths (B) or flux densities interact with the different current levels and directions I-1, I-2, I-3, I-4, I-5, I-6, I-7, I-8, and I-9 in the subcircuits 120*a*, 120*b*, 120*c*, 120*d*, 120*e*, 120*f*, 120*g*, 120*h*, and 120*i*. In this example, the subcircuit currents I-1, I-2, I-3, I-4, I-5, I-6, I-7, I-8, and I-9 are inversely proportional to the flux strengths (B) (flux densities) to result in similar or equivalent Lorentz forces. At the bottom of FIG. 14*b*, average magnetic flux strengths+$B_1$, −$B_2$, and +$B_3$ illustrate and correspond to the magnetic flux strengths as shown in the graph at the bottom of FIG. 14*a*. These magnetic flux strengths are shown in the key on FIG. 15, showing the direction or polarity of the magnetic induction.

In other aspects, different magnetic configurations generate different flux lines and different flux strengths or densities at different locations and interact with different currents in the subcircuits depending upon the design of the diaphragm. In some aspects, the transducer 200 uses different types of magnets, different positions of the magnets, different types of electrically conductive circuits, and different shapes and designs of the subcircuits to achieve similar or equivalent Lorentz forces on the diaphragm 100.

Figure 15:
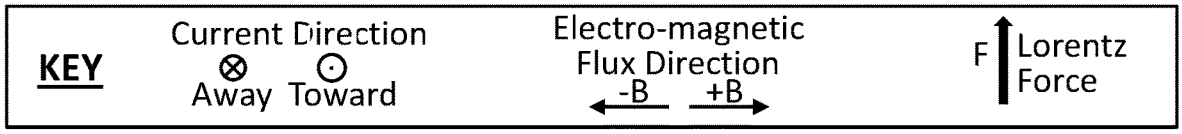
FIG. 15 is a key or legend for the current directions, electro-magnetic flux directions, and Lorentz force.

FIG. 15 is a key showing the current directions, the electro-magnetic flux directions, and the Lorentz force resulting in a uniform force distribution normal or perpendicular across the diaphragm surface.

Figure 16:
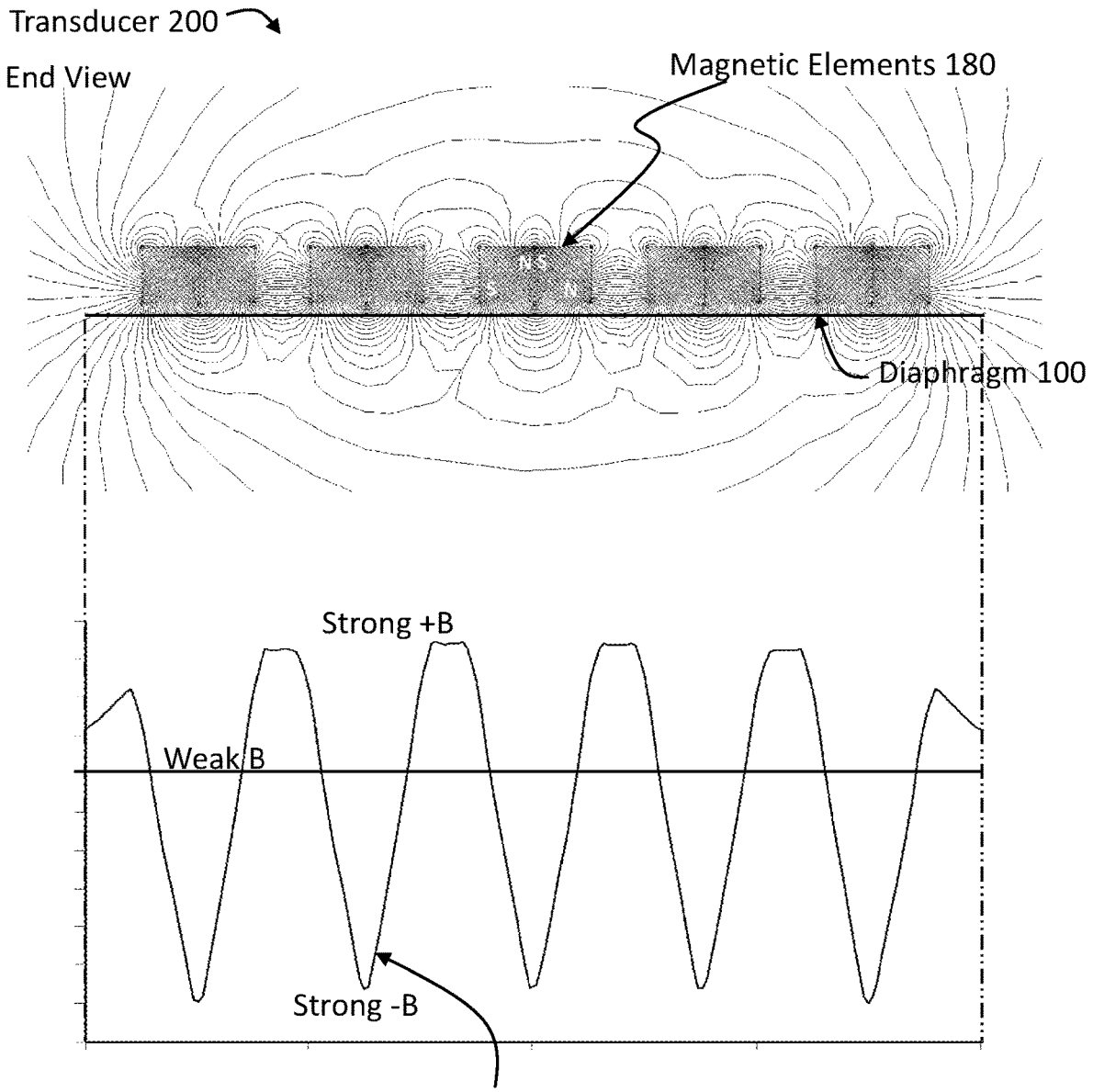
FIG. 16 is a diagram or illustration of the end view of a transducer 200 having multiple angled magnetic pair (Fluxor®) arrays (described in U.S. Pat. No. 9,287,029) or diagonally magnetized magnets on one side of the diaphragm 100 with electrically conductive subcircuits (shown elsewhere in other figures) disposed on the diaphragm 100 configured to interact with the varying flux strengths (B) of the magnetic elements 180 across the surface of the diaphragm (as shown in the correlative graph on the bottom of the figure) to produce comparable or equivalent Lorentz forces resulting in uniform force distribution across the diaphragm.

FIG. 16 is a diagram or illustration of the end view of a transducer 200 and graph of varying flux strengths from magnetic elements 180. In this example, transducer 200 has magnetic elements 180 with multiple angled magnetic pair (Fluxor®) arrays (described in U.S. Pat. No. 9,287,029) or diagonally magnetized magnets on one side of the diaphragm 100 with electrically conductive subcircuits (shown elsewhere in other figures) disposed on the diaphragm 100 configured to interact with the varying flux strengths (B) of the magnetic elements 180 across the surface of the diaphragm (as shown in the correlative graph on the bottom of the figure). This interaction (shown in other figures) produces comparable or equivalent Lorentz forces resulting in uniform force distribution across the diaphragm. In this exemplary transducer diagram, which combines magnetic element graphs with subcircuits (not shown) on the diaphragm 100, the subcircuits are placed such that the strongest currents correlate with the weakest flux strengths (B), the weakest currents correlate with the strongest flux strengths (B), and the medium currents correlate with the medium flux strengths (B). Thus, other aspects include a multitude of possible configurations with this principle in mind.

Figure 17:
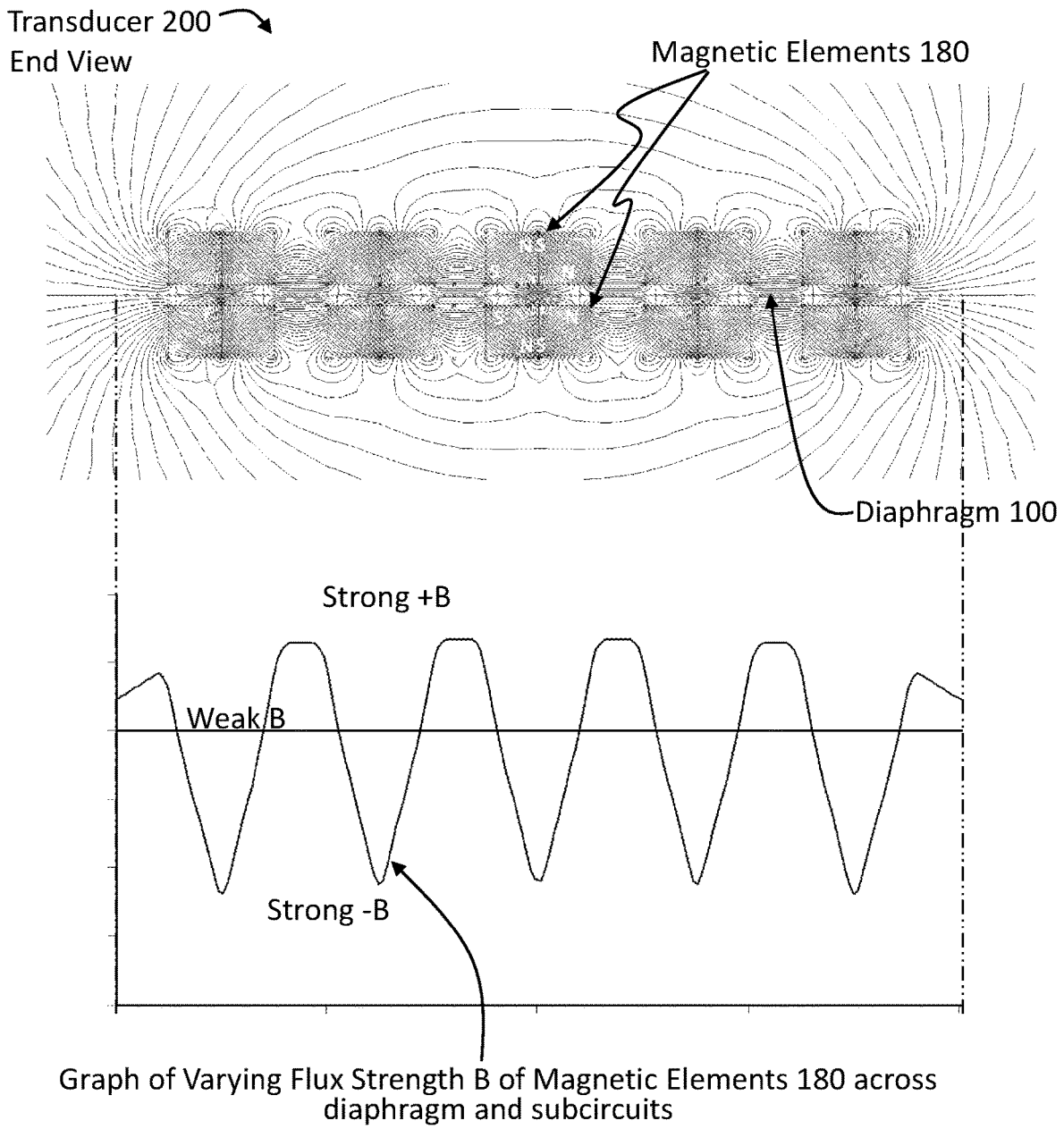
FIG. 17 is a diagram or illustration of the end view or cross-section of a transducer 200 having multiple angled magnetic pair (Fluxor®) arrays (described in U.S. Pat. No. 9,287,029) or diagonally magnetized magnets in direct opposition on both sides of the diaphragm 100 with electrically conductive subcircuits (shown elsewhere in other figures) disposed on the diaphragm 100 configured to interact with the varying flux strengths (B) of the magnetic elements 180 across the surface of the diaphragm (as shown in the correlative graph on the bottom of the figure) to produce comparable or equivalent Lorentz forces resulting in uniform force distribution across the diaphragm.

FIG. 17 is a diagram or illustration of the end view of a transducer 200 and a graph of the varying flux strengths from magnetic elements 180. In this example, transducer 200 has magnetic elements 180 with multiple angled magnetic pair (Fluxor®) arrays (described in U.S. Pat. No. 9,287,029) or diagonally magnetized magnets on both sides of the diaphragm 100 with electrically conductive subcircuits (shown elsewhere in other figures) disposed on the diaphragm 100 configured to interact with the varying flux strengths (B) of the magnetic elements 180 across the surface of the diaphragm (as shown in the correlative graph on the bottom of the figure). This interaction (shown in other figures) produces substantially equivalent Lorentz forces resulting in uniform force distribution across the diaphragm. In this exemplary transducer diagram, which combines magnetic element graphs with subcircuits (not shown) on the diaphragm 100, the subcircuits are placed such that the strongest currents correlate with the weakest flux strengths (B), the weakest currents correlate with the strongest flux strengths (B), and the medium currents correlate with the medium flux strengths (B). Thus, other aspects include a multitude of possible configurations with this principle in mind.

Figure 18:
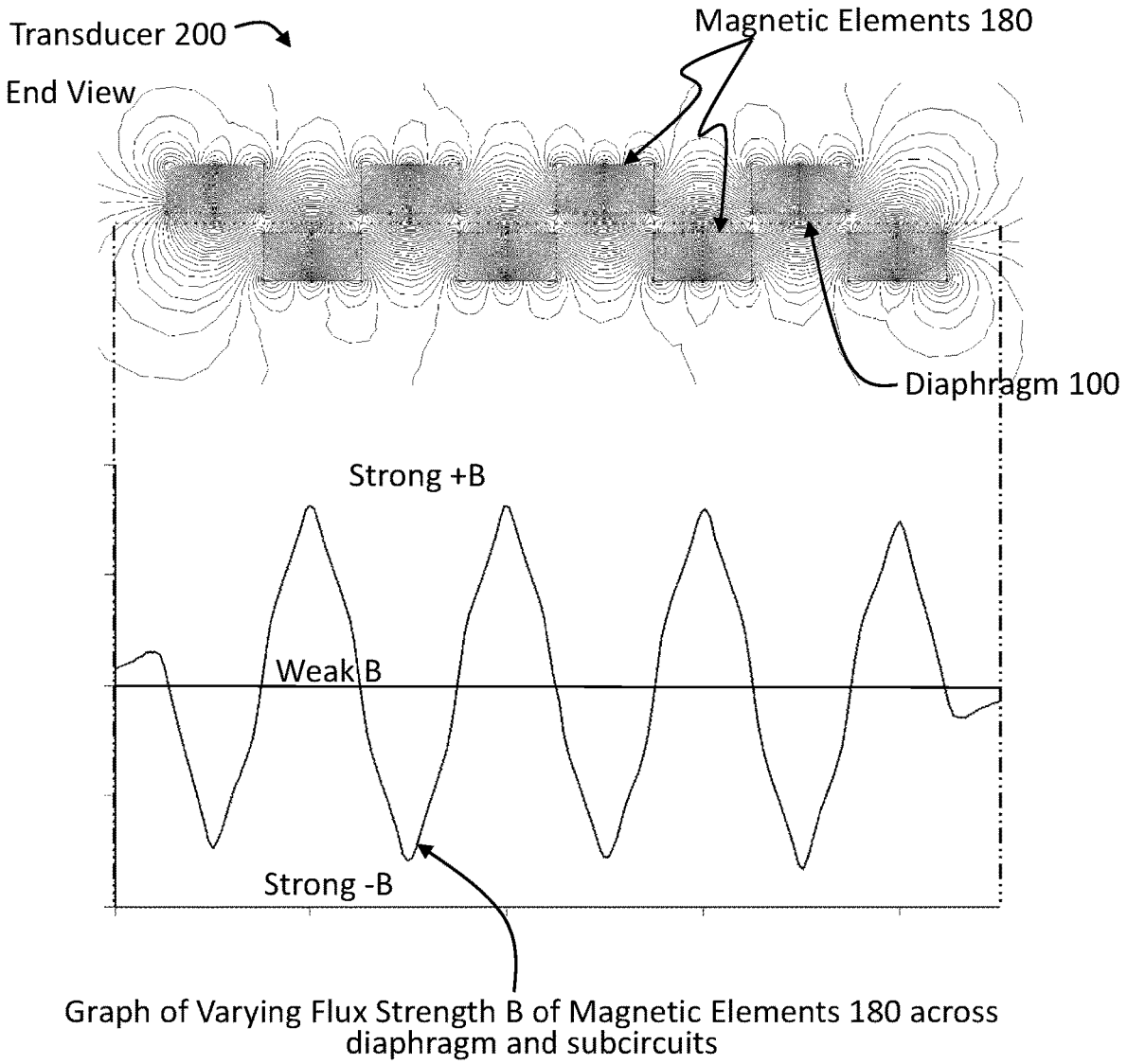
FIG. 18 is a diagram or illustration of the end view of a transducer 200 having multiple angled magnetic pair (Fluxor®) arrays (described in U.S. Pat. No. 9,287,029) or diagonally magnetized magnets in staggered opposition on both sides of the diaphragm 100 with electrically conductive subcircuits (similar to those shown elsewhere in other figures) disposed on the diaphragm 100 configured to interact with the varying flux strengths (B) of the magnetic elements 180 across the surface of the diaphragm (as shown in the correlative graph on the bottom of the figure) to produce comparable or equivalent Lorentz forces resulting in uniform force distribution across the diaphragm.

FIG. 18 is a diagram or illustration of the end view of a transducer 200 and a graph of the varying flux strengths from magnetic elements 180. In this example, transducer 200 has multiple angled magnetic pair (Fluxor®) arrays or diagonally magnetized magnets (described in U.S. Pat. No. 9,287,029) in staggered opposition on both sides of the diaphragm 100 with electrically conductive subcircuits (similar to those shown elsewhere in other figures) disposed on the diaphragm 100 configured to interact with the varying flux strengths (B) of the magnetic elements 180 across the surface of the diaphragm (as shown in the correlative graph on the bottom of the figure) to produce comparable or equivalent Lorentz forces resulting in uniform force distribution across the diaphragm. In this exemplary transducer diagram, which combines magnetic element graphs with subcircuits (not shown) on the diaphragm 100, the subcircuits are placed such that the strongest currents correlate with the weakest flux strengths (B), the weakest currents correlate with the strongest flux strengths (B), and the medium currents correlate with the medium flux strengths (B). Thus, other aspects include a multitude of possible configurations with this principle in mind.

Figure 19:
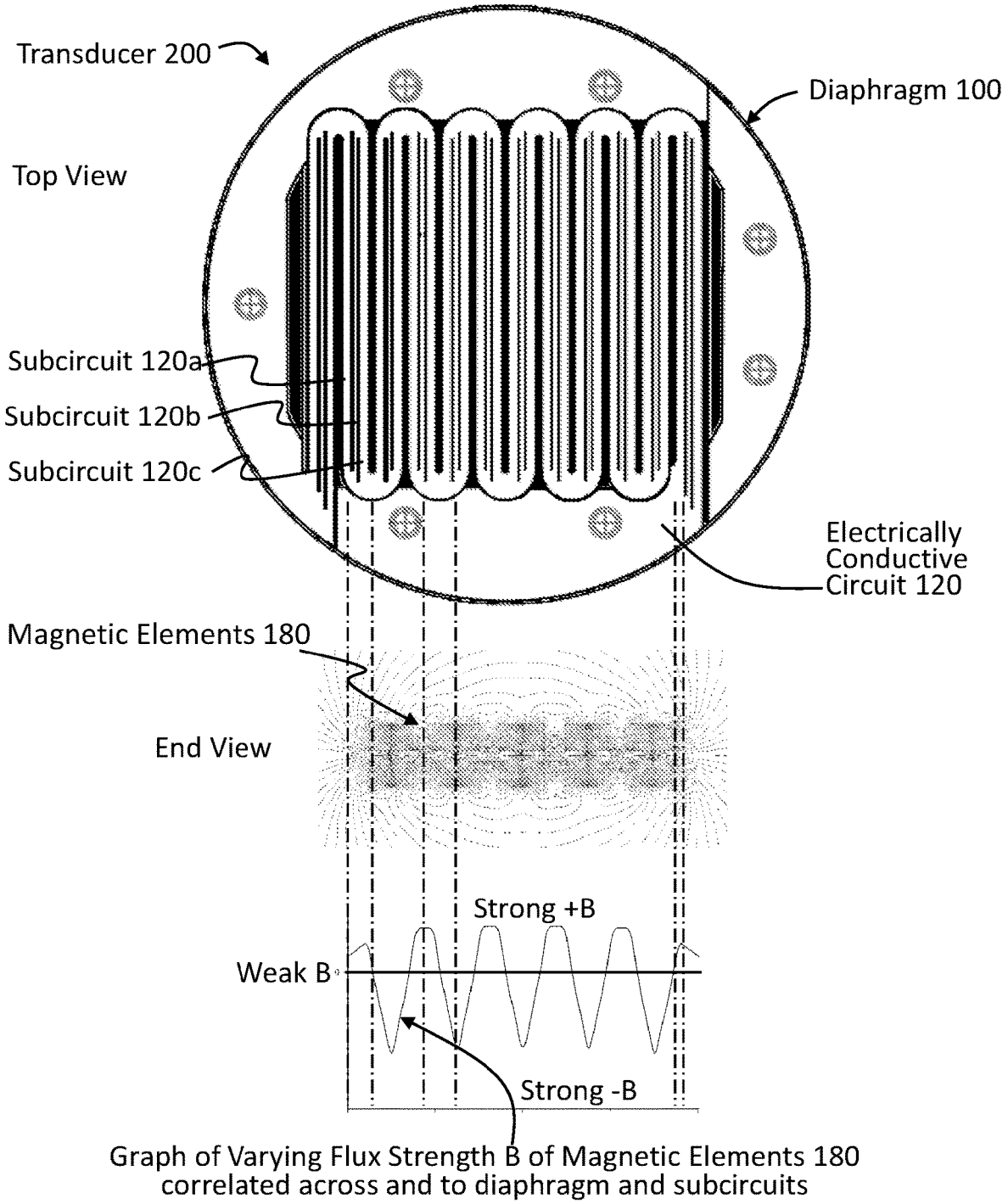
FIG. 19 is an exemplary diagram and illustration of the top view and end view of a transducer 200 having multiple angled magnetic pair (Fluxor®) arrays (described in U.S. Pat. No. 9,287,029) or diagonally magnetized magnets in direct opposition on both sides of the diaphragm 100 with subcircuits 120*a*, 120*b*, 120*c* disposed on the diaphragm 100 configured to interact with the varying flux strengths (B) of the magnetic elements 180 across the surface of the diaphragm (as shown in the correlative graph on the bottom of the figure) to produce comparable or equivalent Lorentz forces from the subcircuits resulting in uniform force distribution across the diaphragm.

FIG. 19 is an exemplary diagram and illustration of the top view and end view of a transducer 200 and a graph of the varying flux strengths from magnetic elements 180. In this example, transducer 200 has magnetic elements 180 with multiple angled magnetic pair (Fluxor®) arrays or diagonally magnetized magnets (described in U.S. Pat. No. 9,287,029) in direct opposition on both sides of the diaphragm 100 with subcircuits 120*a*, 120*b*, 120*c* disposed on the diaphragm 100 configured to interact with the varying flux strengths (B) of the magnetic elements 180 across the surface of the diaphragm (as shown in the correlative graph on the bottom of the figure) to produce substantially equivalent Lorentz forces from the subcircuits resulting in uniform force distribution across the diaphragm. In this exemplary transducer diagram, which combines magnetic element graphs with subcircuits (not shown) on the diaphragm 100, the subcircuits are placed such that the strongest currents correlate with the weakest flux strengths (B), the weakest currents correlate with the strongest flux strengths (B), and the medium currents correlate with the medium flux strengths (B). Thus, other aspects include a multitude of possible configurations with this principle in mind.

Figure 20:
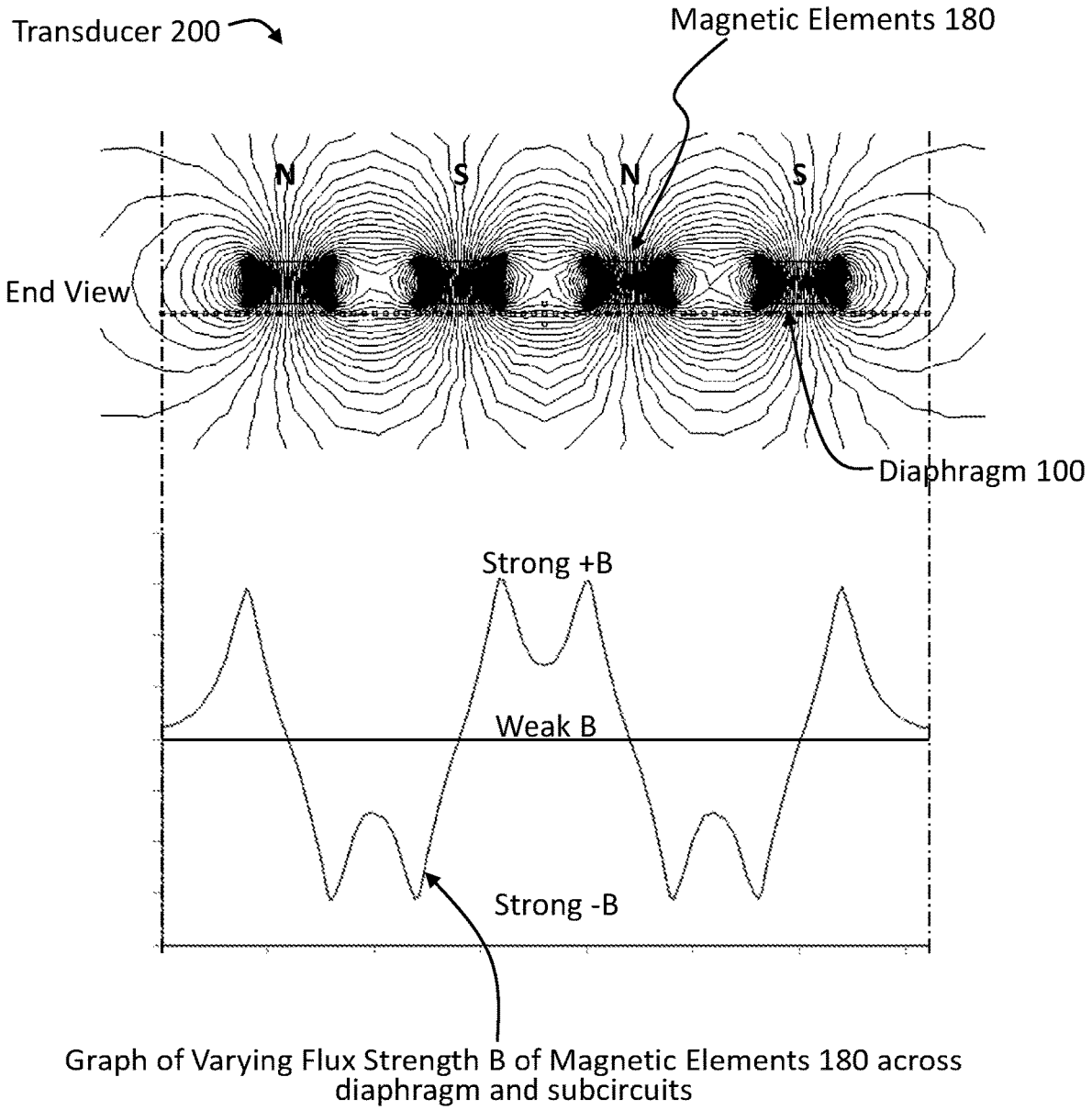
FIG. 20 is a diagram and illustration of the end view of transducer 200 having vertical magnet North-South arrays on one side of the diaphragm 100 which is configured such that the subcircuits (not shown) interact with the varying flux strengths (B) of the magnetic elements 180 shown at the surface of the diaphragm (in the correlative graph on the bottom of the figure) to produce similar, equal, comparable or equivalent Lorentz forces resulting in uniform force distribution across the diaphragm.

FIG. 20 is a diagram and illustration of the end view of transducer 200 and a graph of the varying flux strengths from magnetic elements 180. In this example, transducer 200 has vertical magnet North-South arrays on one side of the diaphragm 100 which is configured such that the subcircuits (not shown) interact with the correlative varying flux strengths (B) of the magnetic elements 180 shown at the surface of the diaphragm (in the correlative graph on the bottom of the figure) to produce comparable or equivalent Lorentz forces resulting in uniform force distribution across the diaphragm. In this exemplary transducer diagram, which combines magnetic element graphs with subcircuits (not shown) on the diaphragm 100, the subcircuits are placed such that the strongest currents correlate with the weakest flux strengths (B), the weakest currents correlate with the strongest flux strengths (B), and the medium currents correlate with the medium flux strengths (B). Thus, other aspects include a multitude of possible configurations with this principle in mind.

Figure 21A:
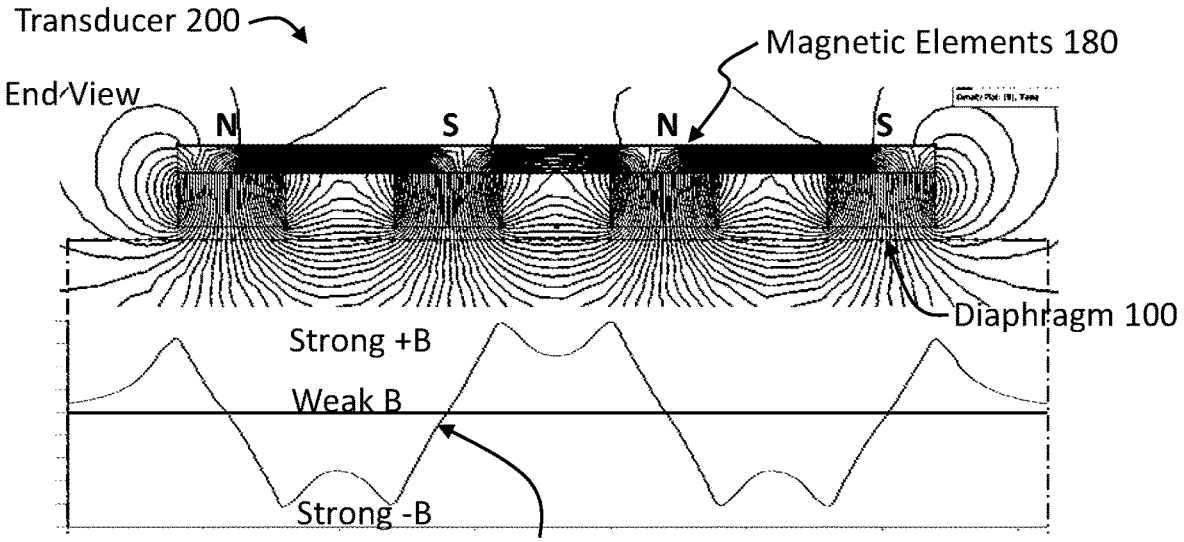
FIG. 21*a* is a diagram and illustration of the end view of transducer 200 having vertical North-South magnet arrays with a backplate on one side of the diaphragm 100 which is configured such that the subcircuits (not shown) interact with the correlative varying flux strengths (B) of the magnetic elements 180 at the surface of the diaphragm (shown in the correlative graph at the bottom of the figure) to produce equal, similar, comparable, or equivalent Lorentz forces resulting in uniform force distribution across the diaphragm.

FIG. 21*a* is a diagram and illustration of the end view of transducer 200 and a graph of the varying flux strengths from magnetic elements 180. In this example, transducer 200 has magnetic elements 180 with vertical North-South magnet arrays with a backplate (generally ferromagnetic) on one side of the diaphragm 100. The magnet arrays are configured such that the subcircuits (not shown) interact with the correlative varying flux strengths (B) of the magnetic elements 180 at the surface of the diaphragm (shown in the correlative graph at the bottom of the figure) to produce substantially equivalent Lorentz forces resulting in uniform force distribution across the diaphragm. In this exemplary transducer diagram, which combines magnetic element graphs with subcircuits (not shown) on the diaphragm 100, the subcircuits are placed such that the strongest currents inversely correlate with the weakest flux strengths (B), the weakest currents inversely correlate with the strongest flux strengths (B), and the medium currents inversely correlate with the medium flux strengths (B). Thus, other aspects include a multitude of possible configurations with this principle in mind.

Figure 21B:
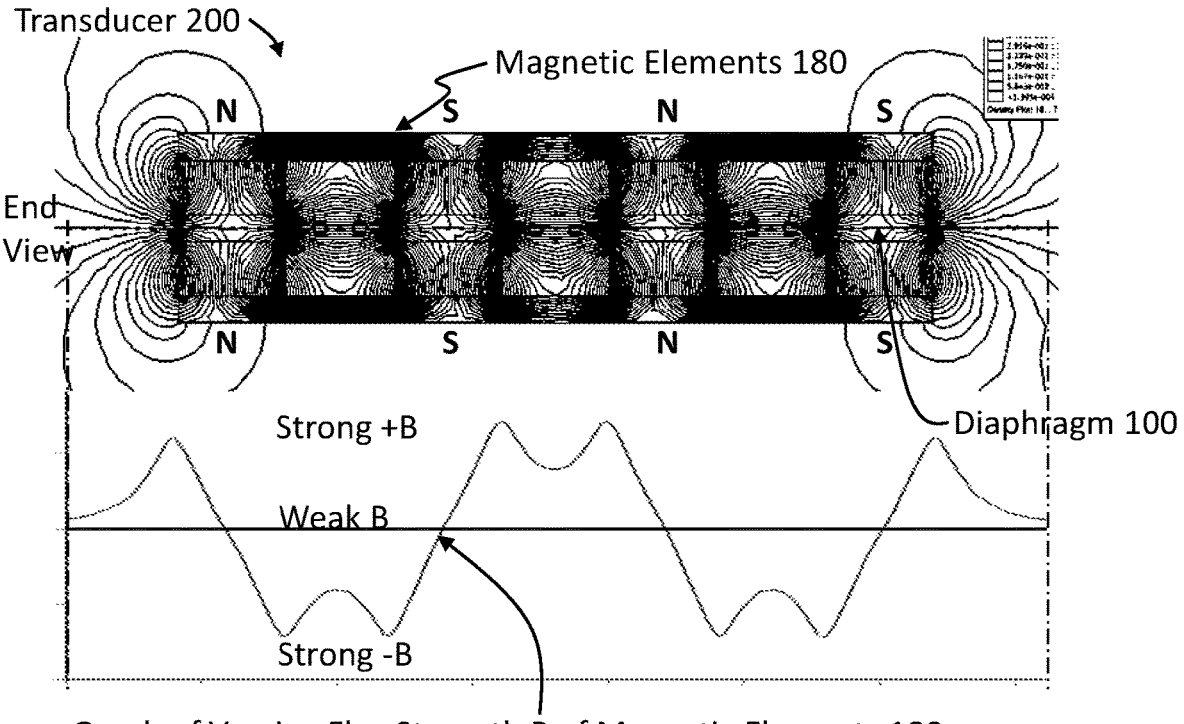
FIG. 21*b* is a diagram and illustration of the end view of transducer 200 having vertical North-South magnet arrays with backplates on both sides of the diaphragm 100 which is configured such that the subcircuits (not shown) interact with the correlative varying flux strengths (B) of the magnetic elements 180 at the surface of the diaphragm (as shown in the correlative graph at the bottom of the figure) to produce comparable or equivalent Lorentz forces resulting in uniform force distribution across the diaphragm.

FIG. 21*b* is a diagram and illustration of the end view of transducer 200 and a graph of the varying flux strengths from magnetic elements 180. In this example, transducer 200 has magnetic elements 180 with vertical North-South magnet arrays with generally ferromagnetic backplates on both sides of the diaphragm 100 which is configured such that the subcircuits (not shown) interact with the correlative varying flux strengths (B) of the magnetic elements 180 at the surface of the diaphragm (as shown in the correlative graph at the bottom of the figure) to produce comparable or equivalent Lorentz forces resulting in uniform force distribution across the diaphragm. In this exemplary transducer diagram, which combines magnetic element graphs with subcircuits (not shown) on the diaphragm 100, the subcircuits are placed such that the strongest currents correlate with the weakest flux strengths (B), the weakest currents correlate with the strongest flux strengths (B), and the medium currents correlate with the medium flux strengths (B). Thus, other aspects include a multitude of possible configurations with this principle in mind.

Figure 22A:
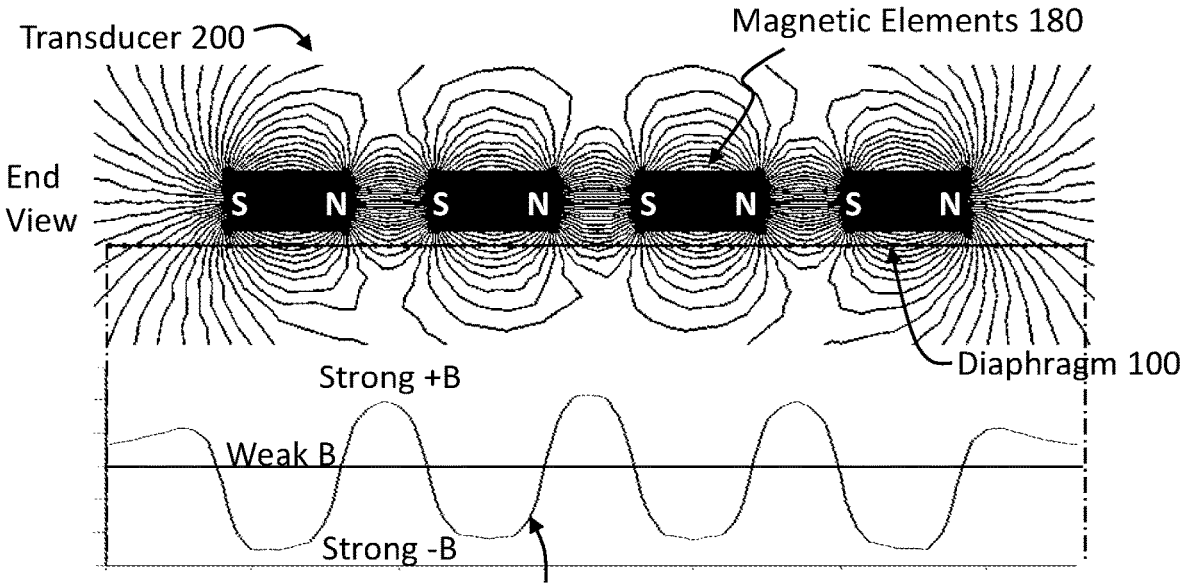
FIG. 22*a* is a diagram and illustration of the end view of transducer 200 having horizontal North-South magnet arrays on one side of the diaphragm 100 which is configured such that the subcircuits (not shown) interact with the correlative varying flux strengths (B) of the magnetic elements 180 at the surface of the diaphragm (shown in the correlative graph at the bottom of the figure) to produce substantially equivalent Lorentz forces resulting in uniform force distribution across the diaphragm.

FIG. 22*a* is a diagram and illustration of the end view of transducer 200 and a graph of the varying flux strengths from magnetic elements 180. In this example, transducer 200 has magnetic elements 180 with horizontal North-South magnet arrays on one side of the diaphragm 100 which is configured such that the subcircuits (not shown) interact with the correlative varying flux strengths (B) of the magnetic elements 180 at the surface of the diaphragm (shown in the correlative graph at the bottom of the figure) to produce substantially equivalent Lorentz forces resulting in uniform force distribution across the diaphragm. In this exemplary transducer diagram, which combines magnetic element graphs with subcircuits (not shown) on the diaphragm 100, the subcircuits are placed such that the strongest currents correlate with the weakest flux strengths (B), the weakest currents correlate with the strongest flux strengths (B), and the medium currents correlate with the medium flux strengths (B). Thus, other aspects include a multitude of possible configurations with this principle in mind.

Figure 22B:
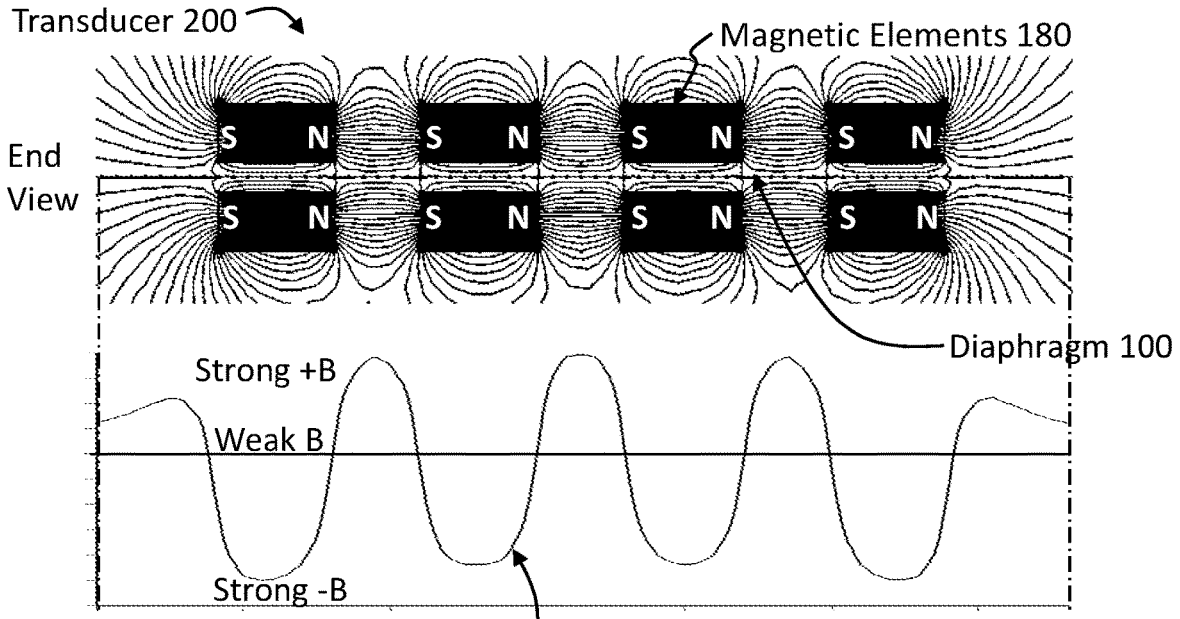
FIG. 22*b* is a diagram and illustration of the end view of transducer 200 having horizontal North-South magnet arrays on both sides of the diaphragm 100 which is configured such that the subcircuits (not shown) interact with the correlative varying flux strengths (B) of the magnetic elements 180 at the surface of the diaphragm (as shown in the correlative graph at the bottom of the figure) to produce substantially equivalent or comparable Lorentz forces resulting in uniform force distribution across the diaphragm.

FIG. 22*b* is a diagram and illustration of the end view of transducer 200 and a graph of the varying flux strengths from magnetic elements 180. In this example, transducer 200 has magnetic elements 180 with horizontal North-South magnet arrays on both sides of the diaphragm 100 which is configured such that the subcircuits (not shown) interact with the correlative varying flux strengths (B) of the magnetic elements 180 at the surface of the diaphragm (as shown in the correlative graph at the bottom of the figure) to produce comparable or equivalent Lorentz forces resulting in uniform force distribution across the diaphragm. In this exemplary transducer diagram, which combines magnetic element graphs with subcircuits (not shown) on the diaphragm 100, the subcircuits are placed such that the strongest currents correlate with the weakest flux strengths (B), the weakest currents correlate with the strongest flux strengths (B), and the medium currents correlate with the medium flux strengths (B). Thus, other aspects include a multitude of possible configurations with this principle in mind.

Figure 23:
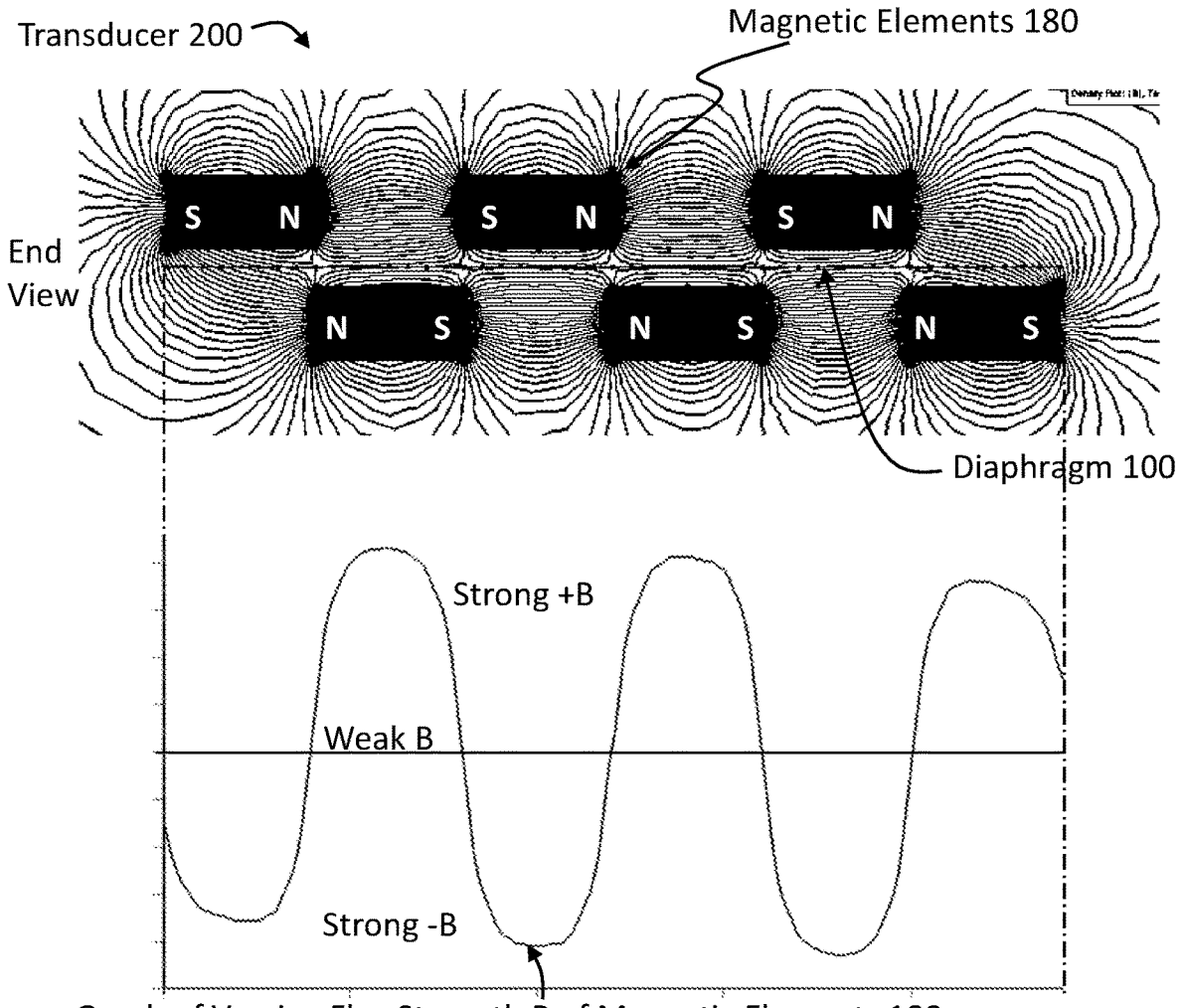
FIG. 23 is a diagram and illustration of the end view of transducer 200 having horizontal North-South magnet arrays in a staggered opposition on both sides of the diaphragm 100 which is configured such that the subcircuits (not shown) interact with the correlative varying flux strengths (B) of the magnetic elements 180 at the surface of the diaphragm (as shown in the correlative graph at the bottom of the figure) to produce comparable or equivalent Lorentz forces resulting in uniform force distribution across the diaphragm.

FIG. 23 is a diagram and illustration of the end view of transducer 200 and a graph of the varying flux strengths from magnetic elements 180. In this example, transducer 200 has magnetic elements 180 with horizontal North-South magnet arrays in a staggered opposition on both sides of the diaphragm 100 which is configured such that the subcircuits (not shown) interact with the correlative varying flux strengths (B) of the magnetic elements 180 at the surface of the diaphragm (as shown in the correlative graph at the bottom of the figure) to produce substantially equivalent Lorentz forces resulting in uniform force distribution across the diaphragm. In this exemplary transducer diagram, which combines magnetic element graphs with subcircuits (not shown) on the diaphragm 100, the subcircuits are placed such that the strongest currents correlate with the weakest flux strengths (B), the weakest currents correlate with the strongest flux strengths (B), and the medium currents correlate with the medium flux strengths (B). Thus, other aspects include a multitude of possible configurations with this principle in mind.

Figure 24A:
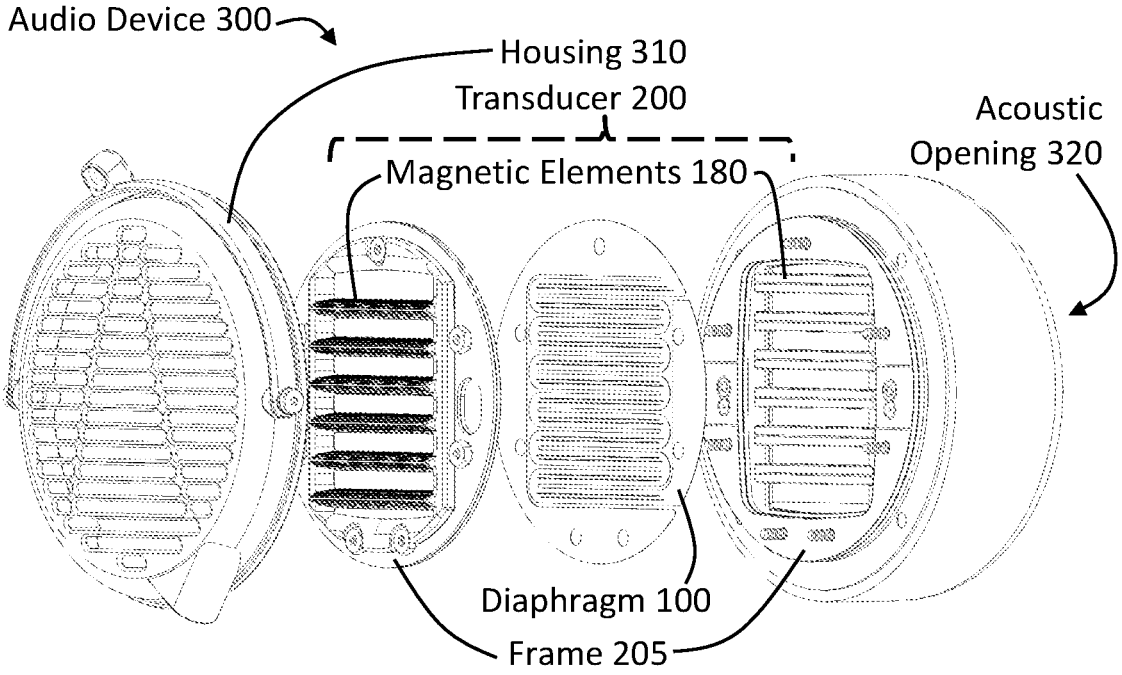
FIG. 24*a* is an exploded view of an illustration of an audio device 300 comprising a housing 310 having an acoustic opening 320 and a transducer 200 disposed in the housing 310, where the transducer 200 is described elsewhere in this document and illustrated in FIGS. 11-23.

FIG. 24*a* is an exploded view of an illustration of an audio device 300 comprising a housing 310 having an acoustic opening 320 and a transducer 200 (shown by dashed bracket lines) disposed in the housing, wherein the transducer 200 is described and shown elsewhere in this document and illustrated in FIGS. 11-23. The housing 310 comprises multiple components as shown. Alternatively, the housing 310 comprises a single component. Alternatively, the housing 310 is part of the transducer. Alternatively, the housing 310 can be the stator where the magnets are placed. FIG. 24*a* also shows that the transducer 200 comprises a frame(s) 205, magnetic element(s) 180, and a diaphragm 100 with segments and subcircuits as disclosed in FIGS. 1-10. Frame 205 comprises multiple components as shown. Alternatively, frame 205 is a single component. FIG. 24*a* is an illustration of an audio device 300 as exemplified in a headphone. The same elements are disclosed where the audio device 300 is used as a speaker, a loudspeaker, an earphone, an in-ear earphone, and a microphone (not shown).

Figure 24B:
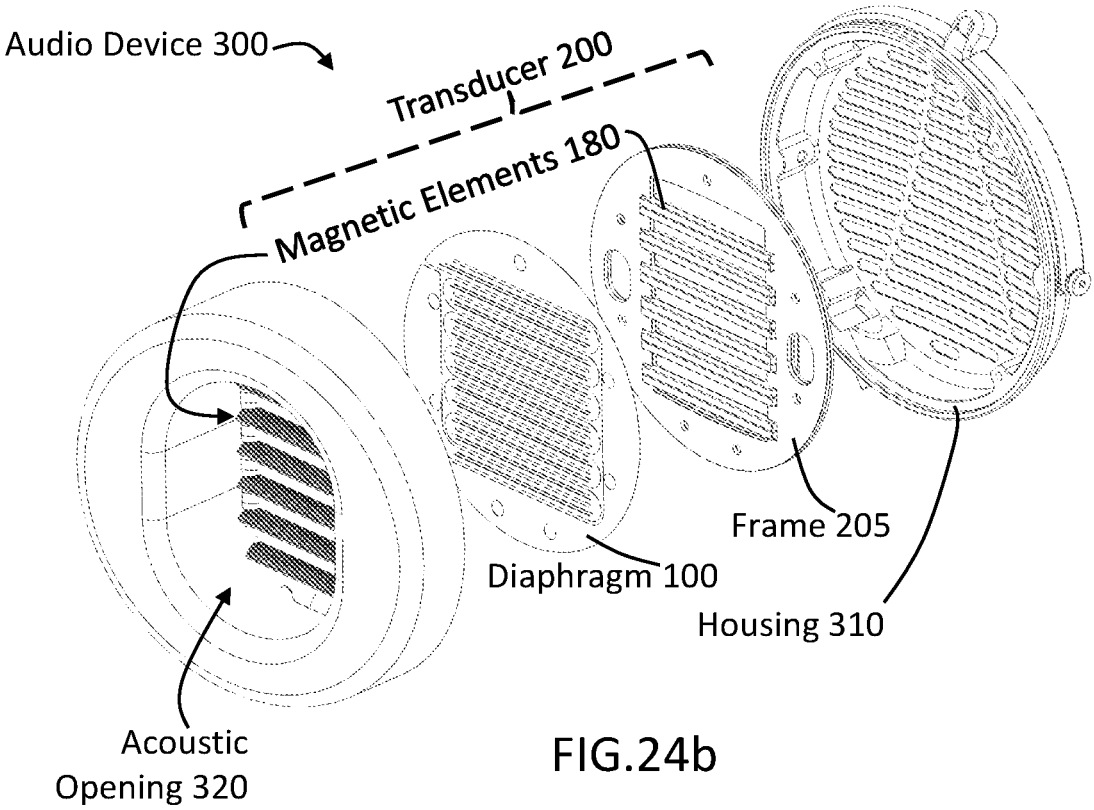
FIG. 24*b* is an exploded view of an illustration of an audio device 300 comprising a housing 310 having an acoustic opening 320 and a transducer 200 disposed in the housing 310, where the transducer 200 is described elsewhere in the document and illustrated in FIGS. 11-23.

FIG. 24*b* is another view of FIG. 24*a*, an exploded view of an illustration of an audio device 300 comprising a housing 310 having an acoustic opening 320 and a transducer 200 disposed in the housing, where the transducer 200 is described and shown elsewhere in this document and illustrated in FIGS. 11-23. The housing 310 comprises multiple components as shown. Alternatively, the housing 310 comprises a single component. FIG. 24*b* also shows that the transducer 200 comprises a frame 205, magnetic element(s) 180, and a diaphragm 100 with segments and subcircuits as disclosed in FIGS. 1-10. Frame 205 comprises a single component as shown. Alternatively, frame 205 comprises multiple components. FIG. 24*b* is an illustration of an audio device 300 as used as a headphone. The same elements in FIG. 24*b* are disclosed for where the audio device 300 is used as a speaker, a loudspeaker, an earphone, an in-ear earphone, and a microphone (not shown).

Figure 25:
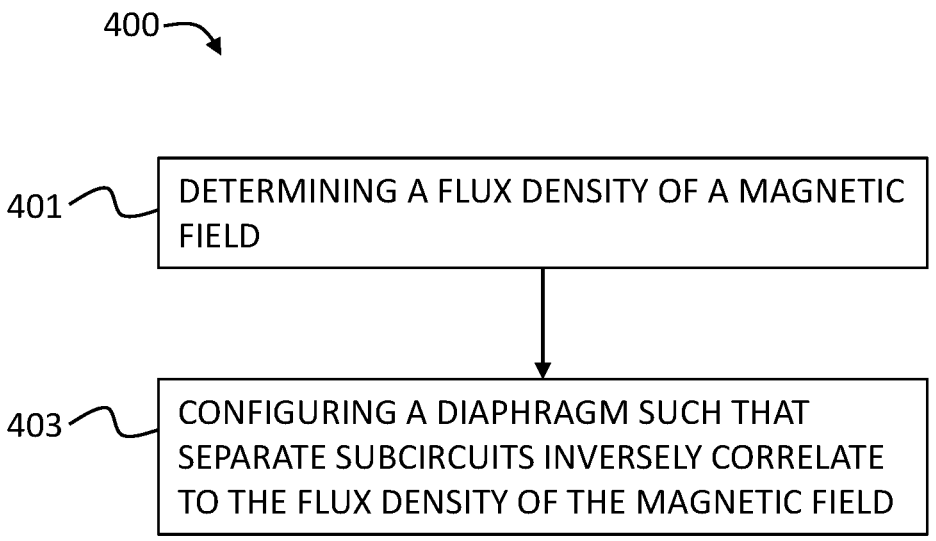
FIG. 25 is an illustrative flowchart 400 of a method for constructing a transducer by determining 401 a flux density of a magnetic field of a magnet or magnet array and configuring 403 a diaphragm 100 so that two or more separate subcircuits correlate or inversely correlate to the flux density of the magnetic field.

FIG. 25 is an illustrative flowchart 400 of a method for constructing a transducer (also shown in FIGS. 11-23) comprising the steps of determining 401 a flux density of a magnetic field and configuring 403 a diaphragm 100 so that two or more separate subcircuits 120*a*, 120*b*, and 120*c* correlate or inversely correlate to the flux density of the magnetic field. A further aspect of this method (not shown) is a step to ablate, delaminate, etch, erode, structure, create, manufacture, form, or embed subcircuits in and/or on the diaphragm 100 with lasers, chemicals, vaporization, deposition, or other means to achieve an optimized correlation of the flux density of the magnetic field with the dimensions of the subcircuits on the diaphragm. In a further aspect of a method (not shown in FIG. 25 but described in FIG. 9), an application of an electric voltage across the electrically conductive subcircuits 120 creates a uniform force distribution across the subcircuits and the diaphragm.

Other features, aspects and objects can be obtained from a review of the figures and the claims. It is to be understood that other aspects can be developed and fall within the spirit and scope of the inventive disclosure.

While some of the best modes and other embodiments have been described in detail, various alternative designs and embodiments exist for practicing the present teachings defined in the appended claims. Those skilled in the art will recognize that modifications may be made to the disclosed embodiments without departing from the scope of the present disclosure. Moreover, the present concepts expressly include combinations and sub-combinations of the described elements and features. The detailed description and the drawings are supportive and descriptive of the present teachings, with the scope of the present teachings defined solely by the claims.

The foregoing description of the present aspects has been provided for the purposes of illustration and description. It is not intended to be exhaustive or to limit the invention to the precise forms disclosed. Various additions, deletions and modifications are contemplated as being within its scope. The scope is, therefore, indicated by the appended claims with reference to the foregoing description. Further, all changes which may fall within the meaning and range of equivalency of the claims and elements and features thereof are to be embraced within their scope.

What is claimed is:

1. A diaphragm comprising:

a membrane of a planar magnetic speaker, the membrane having a surface; and an electrically conductive trace carried by the membrane, wherein a segment of the electrically conductive trace is divided into two or more separate subtraces configured to conduct different current strengths.

2. The diaphragm of claim 1 wherein the two or more separate subtraces of the segment extend for a length of the electrically conductive circuit.

3. The diaphragm of claim 1 wherein the two or more separate subtraces have different widths.

4. The diaphragm of claim 1 wherein at least two separate subtraces have different thicknesses.

5. The diaphragm of claim 1 wherein the two or more separate subtraces are electrically in parallel.

6. The diaphragm of claim 1 wherein the two or more separate subtraces are electrically equivalent to a parallel impedance circuit.

7. The diaphragm of claim 1 wherein the two or more separate subtraces have different resistances.

8. The diaphragm of claim 7 wherein the different resistances of the two or more separate subtraces is determined by at least one of different heights, different widths, different lengths, different shapes, and different specific resistivities.

9. The diaphragm of claim 1 wherein a voltage across the electrically conductive trace generates different electrical currents through the two or more separate subtraces.

10. The diaphragm of claim 1 wherein carried by the membrane includes at least one of: the electrically conductive trace disposed on one side of the membrane, the electrically conductive trace disposed on both sides of the membrane, or the electrically conductive trace disposed within the membrane.

11. A transducer comprising:

a frame;

a diaphragm supported by the frame, the diaphragm having a membrane of a planar magnetic speaker, the membrane having a surface, the membrane carrying an electrically conductive trace with a segment of the electrically conductive trace operably divided into two or more separate subtraces configured to conduct different current strengths; and a magnetic element disposed adjacent to the surface of the diaphragm.

12. The transducer of claim 11 wherein the two or more separate subtraces of the segment extend for a length of the electrically conductive trace.

13. The transducer of claim 11 whereby a voltage connected across the two or more separate subtraces generates two or more different current levels in the two or more separate subtraces.

14. The transducer of claim 13 wherein varying flux strengths of the magnetic element across the diaphragm are correlated with the two or more separate subtraces conducting the two or more different current levels thereby generating comparable Lorentz forces in the two or more separate subtraces.

15. The transducer of claim 14 wherein the comparable Lorentz forces generated in the two or more separate subtraces exert a uniform force distribution across the diaphragm.

16. The transducer of claim 11 wherein the magnetic element comprises multiple magnetic elements of angularly magnetized magnets.

17. The transducer of claim 11 wherein the magnetic element comprises multiple magnetic elements disposed on both sides of the diaphragm.

18. The transducer of claim 11 wherein the magnetic element comprises multiple magnets configured in at least one of direct opposition, staggered opposition, and a combination of direct opposition and staggered opposition.

19. The transducer of claim 11 wherein the magnetic element comprises multiple magnets from at least one of vertical magnets, vertical magnets with back plates, horizontal magnets, block magnets, disc magnets, U-channel magnets, horseshoe magnets, serpentine magnets, and Halbach magnets.

20. The transducer of claim 11 wherein the magnetic element is at least one of a round magnet, a curved magnet, a straight magnet, a diagonally magnetized magnet, a Fluxor® magnet, a square magnet, and a bar magnet.

21. An audio device comprising:

a housing having an acoustic opening; and a planar magnetic transducer disposed in the housing, the transducer comprising:

a frame;

a diaphragm supported by the frame, the diaphragm having a membrane and a surface, the membrane carrying an electrically conductive trace with a segment of the electrically conductive trace operably divided into two or more separate subtraces configured to conduct different current strengths; and a magnetic element disposed adjacent to the diaphragm surface.

22. A method of constructing a transducer comprising the steps of:

determining a flux density of a magnetic field; and configuring a diaphragm, the diaphragm having a membrane of a planar magnetic speaker, the membrane having a surface, the membrane carrying an electrically conductive trace with a segment of the electrically conductive trace operably divided into two or more separate subtraces configured to conduct different current strengths such that the two or more separate subtraces configured to conduct different current strengths inversely correlate to the flux density of the magnetic field.

* * * * *